US007770312B2

(12) United States Patent
Stinson et al.

(10) Patent No.: US 7,770,312 B2
(45) Date of Patent: Aug. 10, 2010

(54) FLAME STIMULATING ASSEMBLY

(75) Inventors: Kelly Stinson, Kitchener (CA); Kristoffer Hess, Cambridge (CA)

(73) Assignee: Dimplex North America Limited, Cambridge, ON (CA)

( * ) Notice: Subject to any disclaimer, the term of this patent is extended or adjusted under 35 U.S.C. 154(b) by 798 days.

(21) Appl. No.: 11/622,771

(22) Filed: Jan. 12, 2007

(65) Prior Publication Data

US 2007/0107280 A1 May 17, 2007

Related U.S. Application Data

(63) Continuation-in-part of application No. 10/759,143, filed on Jan. 20, 2004, now Pat. No. 7,162,820.

(51) Int. Cl.
*G09F 19/00* (2006.01)

(52) U.S. Cl. ..... 40/428

(58) Field of Classification Search ..... 40/428
See application file for complete search history.

(56) References Cited

U.S. PATENT DOCUMENTS

| | | | |
|---|---|---|---|
| 1,514,552 | A | 11/1924 | McCormick |
| 1,531,171 | A | 3/1925 | Berry et al. |
| 1,586,597 | A | 6/1926 | Berry |
| 1,719,622 | A | 7/1929 | Price |
| 1,768,284 | A | 6/1930 | Berry |
| 1,809,164 | A | 6/1931 | Gritt |
| 1,824,388 | A | 9/1931 | Birch |
| 1,827,941 | A | 10/1931 | Gross |
| 1,843,279 | A | 2/1932 | Gritt |
| 1,901,294 | A | 3/1933 | Gritt et al. |
| 1,992,540 | A | 2/1935 | Newton |
| 2,285,535 | A | 6/1942 | Schlett |
| 2,631,040 | A | 3/1953 | Constantine |
| 2,708,114 | A | 5/1955 | Hancock |
| 2,963,807 | A | 12/1960 | Relph et al. |
| 2,984,032 | A | 5/1961 | Cornell |
| 3,395,475 | A | 8/1968 | Moss |

(Continued)

FOREIGN PATENT DOCUMENTS

| | | |
|---|---|---|
| EP | 0 348 137 | 12/1989 |

(Continued)

OTHER PUBLICATIONS

Cross-referencing: claims as filed from U.S. Appl. No. 11/609,027 which is also a C-I-P of the same parent application, (i.e., U.S. Appl. No. 10/759,143, now Patent No. 7,162,820).

*Primary Examiner*—Gary C Hoge

(57) ABSTRACT

A flame simulating assembly for providing one or more images of flames. The flame simulating assembly includes one or more light sources for producing the image of flames and a screen with a front surface and positioned in a path of light from the light source. The screen is adapted for transmission of the images of flames through the screen. The assembly also includes one or more simulated interior fireplace walls positioned behind the screen, a first simulated fuel bed positioned in front of the screen and a second simulated fuel bed positioned behind the screen and at least partially viewable through the screen. The screen is adapted to permit observation of at least part of the simulated interior fireplace wall.

18 Claims, 26 Drawing Sheets

U.S. PATENT DOCUMENTS

| | | | | |
|---|---|---|---|---|
| 3,395,476 | A | 8/1968 | Moss et al. | |
| 3,445,948 | A | 5/1969 | Moss et al. | |
| 3,499,239 | A | 3/1970 | Mungo | |
| 3,500,126 | A | 3/1970 | Ford | |
| 3,506,876 | A | 4/1970 | Antonich | |
| 3,603,013 | A | 9/1971 | Reed et al. | |
| 3,699,697 | A | 10/1972 | Painton | |
| 3,710,182 | A | 1/1973 | Van Reenen | |
| 3,742,189 | A | 6/1973 | Conroy et al. | |
| 3,978,598 | A | 9/1976 | Rose et al. | |
| 4,026,544 | A | 5/1977 | Plambeck et al. | |
| 4,064,414 | A | 12/1977 | Bergeson et al. | |
| 4,253,045 | A | 2/1981 | Weber | |
| 4,573,905 | A | 3/1986 | Meyers | |
| 4,890,600 | A | 1/1990 | Meyers | |
| 4,965,707 | A * | 10/1990 | Butterfield | 362/96 |
| 5,032,766 | A | 7/1991 | Gundlach et al. | |
| 5,195,820 | A | 3/1993 | Rehberg | |
| 5,642,580 | A | 7/1997 | Hess et al. | |
| 5,648,827 | A | 7/1997 | Shaw | |
| 5,787,618 | A | 8/1998 | Mullis | |
| 6,047,489 | A | 4/2000 | Hess et al. | |
| 6,050,011 | A * | 4/2000 | Hess et al. | 40/428 |
| 6,190,019 | B1 | 2/2001 | Hess | |
| 6,269,567 | B1 * | 8/2001 | MacPherson et al. | 40/428 |
| 6,302,555 | B1 | 10/2001 | Bristow | |
| 6,363,636 | B1 * | 4/2002 | Hess et al. | 40/428 |
| 6,385,881 | B1 | 5/2002 | Hess | |
| 6,393,207 | B1 | 5/2002 | Martin et al. | |
| 6,413,079 | B1 | 7/2002 | Lyons et al. | |
| 6,461,011 | B1 * | 10/2002 | Harrison | 362/96 |
| 6,564,485 | B1 | 5/2003 | Hess et al. | |
| 6,615,519 | B2 | 9/2003 | Hess | |
| 6,688,752 | B2 | 2/2004 | Moore | |
| 6,691,440 | B1 | 2/2004 | Petz et al. | |
| 6,718,665 | B2 | 4/2004 | Hess et al. | |
| 6,719,443 | B2 | 4/2004 | Gutstein et al. | |
| 6,757,487 | B2 | 6/2004 | Martin et al. | |
| 6,880,275 | B2 | 4/2005 | Mix et al. | |
| 7,080,472 | B2 | 7/2006 | Schroeter et al. | |
| 7,111,421 | B2 | 9/2006 | Corry et al. | |
| 7,134,229 | B2 | 11/2006 | Hess et al. | |
| 7,162,820 | B2 | 1/2007 | Hess et al. | |
| 7,194,830 | B2 | 3/2007 | Hess | |
| 7,373,743 | B1 | 5/2008 | Hess | |
| 2001/0033488 | A1 | 10/2001 | Chliwnyj et al. | |
| 2002/0023376 | A1 | 2/2002 | Hess | |
| 2002/0139021 | A1 | 10/2002 | Hess et al. | |
| 2002/0152655 | A1 | 10/2002 | Merrill et al. | |
| 2002/0166554 | A1 | 11/2002 | Berg | |
| 2002/0168182 | A1 | 11/2002 | Martin et al. | |
| 2002/0170215 | A1 | 11/2002 | Mix et al. | |
| 2002/0175215 | A1 | 11/2002 | Webster et al. | |
| 2003/0041491 | A1 | 3/2003 | Mix | |
| 2003/0046837 | A1 | 3/2003 | Hess | |
| 2003/0072565 | A1 | 4/2003 | Ravnbo-West et al. | |
| 2003/0110671 | A1 | 6/2003 | Hess | |
| 2003/0126775 | A1 * | 7/2003 | Corry et al. | 40/428 |
| 2003/0156828 | A1 | 8/2003 | Jamieson et al. | |
| 2003/0201957 | A1 | 10/2003 | Mix et al. | |
| 2004/0060213 | A1 | 4/2004 | Schroeter et al. | |
| 2004/0114351 | A1 | 6/2004 | Stokes et al. | |
| 2004/0173202 | A1 | 9/2004 | Lyons et al. | |
| 2004/0181983 | A1 | 9/2004 | Hess et al. | |
| 2004/0264949 | A1 | 12/2004 | Deng | |
| 2005/0063685 | A1 | 3/2005 | Bristow | |
| 2005/0097792 | A1 | 5/2005 | Naden | |
| 2005/0155262 | A1 | 7/2005 | Mix et al. | |
| 2005/0252051 | A1 | 11/2005 | Chen | |
| 2006/0026894 | A1 | 2/2006 | Hess et al. | |
| 2006/0101681 | A1 | 5/2006 | Hess et al. | |
| 2006/0162198 | A1 | 7/2006 | Hess et al. | |
| 2006/0185664 | A1 | 8/2006 | Butler et al. | |
| 2006/0188831 | A1 | 8/2006 | Hess et al. | |
| 2006/0242870 | A1 | 11/2006 | Atemboski et al. | |
| 2007/0094903 | A1 | 5/2007 | Hess et al. | |
| 2007/0175074 | A1 * | 8/2007 | O'Neill | 40/428 |
| 2007/0224561 | A1 | 9/2007 | Hess et al. | |

FOREIGN PATENT DOCUMENTS

| | | |
|---|---|---|
| EP | 0 611 921 | 8/1994 |
| EP | 1 020 685 | 7/2000 |
| EP | 1 199 524 | 4/2002 |
| EP | 1 239 223 | 9/2002 |
| EP | 1 271 060 | 1/2003 |
| EP | 1 439 351 | 7/2004 |
| EP | 1 313 987 | 11/2005 |
| EP | 04 25 0277 | 2/2006 |
| GB | 272836 | 6/1927 |
| GB | 322688 | 12/1929 |
| GB | 397594 | 8/1933 |
| GB | 957591 | 5/1964 |
| GB | 968568 | 9/1964 |
| GB | 975009 | 11/1964 |
| GB | 978364 | 12/1964 |
| GB | 978365 | 12/1964 |
| GB | 1024047 | 3/1966 |
| GB | 1088577 | 10/1967 |
| GB | 1097812 | 1/1968 |
| GB | 1164143 | 9/1969 |
| GB | 1186655 | 4/1970 |
| GB | 1443772 | 7/1976 |
| GB | 2151772 | 7/1985 |
| GB | 2210969 | 6/1989 |
| GB | 2222000 | 2/1990 |
| GB | 2240171 | 7/1991 |
| GB | 2242737 | 10/1991 |
| GB | 2275105 | 8/1994 |
| GB | 2276444 | 9/1994 |
| GB | 2288052 | 10/1995 |
| GB | 2290374 | 12/1995 |
| GB | 2290865 | 1/1996 |
| GB | 2298073 | 8/1996 |
| GB | 2302172 | 1/1997 |
| GB | 2302730 | 1/1997 |
| GB | 2321700 | 8/1998 |
| GB | 2372807 | 9/2002 |
| GB | 2379009 | 2/2003 |
| GB | 2408322 | 5/2005 |
| GB | 2409323 | 6/2005 |
| WO | 01/57447 | 8/2001 |
| WO | 2004/027321 | 4/2004 |
| WO | 2004/109189 | 12/2004 |
| WO | 2005/028962 | 3/2005 |
| WO | 2005/078350 | 8/2005 |
| WO | 2006/027272 | 3/2006 |
| WO | 2006/027273 | 3/2006 |
| WO | 2006/040167 | 4/2006 |
| WO | WO 2006/040342 | 4/2006 |
| WO | WO 2007/147887 | 12/2007 |
| WO | 2008/149117 | 12/2008 |
| WO | WO 2008/151951 | 12/2008 |

* cited by examiner

FLAME STIMULATING ASSEMBLY

This application is a continuation-in-part of prior application Ser. No. 10/759,143, filed Jan. 20, 2004.

FIELD OF THE INVENTION

The present invention relates to a flame simulating assembly adapted for displaying an image of flames.

BACKGROUND OF THE INVENTION

Various types of flame simulating assemblies are known. Often, a flame simulating assembly is designed to be included in an electric fireplace, to simulate a fire in a real fireplace. For example, U.S. Pat. No. 4,965,707 (Butterfield) discloses a simulated flame system for an electric fireplace in which a light source is combined with billowing ribbons to simulate flames. The effect resulting tends to resemble flames from a coal fuel source more than flames from a wood fuel source. The flames for burning wooden logs tend to be more active and extend higher above the fuel source.

Known flame simulating assemblies have certain advantages over actual fireplaces, in which a combustible fuel (usually wood or coal, or natural gas) can be burned. Among other things, electric flame simulating assemblies can be used in an interior room (such as in a condominium building or a hotel) from which access to a chimney (i.e., for an actual fireplace) would be difficult. Also, and in particular, known flame simulating assemblies usually occupy less space than actual fireplaces.

The relatively narrow configurations of known flame simulating assemblies is one of their advantages, as noted above. However, known flame simulating assemblies typically have somewhat less depth (i.e., distance from front to back) than ordinary fireplaces. Due to this, the overall effect presented by these flame simulating assemblies is often not as realistic as may be desirable. This is because the relatively smaller depth of the typical flame simulating assembly, as compared to the usual depth of a real fireplace, tends to undermine the overall simulation effect sought with the typical flame simulating assembly.

There is therefore a need for an improved flame simulating assembly adapted for displaying an image of flames.

SUMMARY OF THE INVENTION

In a broad aspect of the present invention, there is provided a flame simulating assembly for providing one or more images of flames. The flame simulating assembly includes one or more light sources for producing the image of flames and a screen having a front surface which is positioned in a path of light from the light source. The screen is adapted for transmission of the image of flames through the screen. The flame simulating assembly also includes one or more simulated interior fireplace walls positioned behind the screen, a first simulated fuel bed positioned in front of the screen, and a second simulated fuel bed positioned behind the screen and at least partially viewable through the screen. The screen is adapted to permit observation of at least part of the simulated interior fireplace wall.

In one of its aspects, the front surface of the screen includes one or more observation regions through which at least part of the simulated interior fireplace wall is observable.

In another aspect, the front surface of the screen includes a viewing region through which the image of flames is transmittable.

In yet another aspect, the viewing region is partially reflective, for providing a virtual image of at least part of the first simulated fuel bed.

In another of its aspects, at least a preselected portion of the second simulated fuel bed is positioned relative to the virtual image so that the second simulated fuel bed appears to be part of the first simulated fuel bed.

In another aspect, the simulated interior fireplace wall is a back wall and the flame simulating assembly additionally includes side walls extending from the back wall beyond the front surface of the screen.

In yet another aspect, the invention additionally includes one or more background light sources for providing light to at least partially illuminate the simulated interior fireplace wall.

In another of its aspects, the invention additionally includes a transition region disposed between the observation region and the viewing region, and the simulated interior fireplace wall is at least partially observable through the transition region. Also, the image of flames is at least partially transmittable through the transition region.

In another of its aspects, the invention provides a flame simulating assembly for providing one or more image of flames. The flame simulating assembly includes one or more light sources for producing one or more images of flames and a screen including a front surface and positioned in a path of light from the light source. The screen is adapted for transmission of the image of flames through the screen. The flame simulating assembly also includes one or more simulated interior fireplace walls positioned behind the screen and one or more background light sources to at least partially illuminate the simulated interior fireplace wall. The front surface of the screen includes one or more observation regions, the observation region being adapted to permit observation of at least part of the simulated interior fireplace wall.

In yet another of its aspects, the invention additionally includes a first simulated fuel bed positioned in front of the screen and a second simulated fuel bed positioned behind the screen.

In another aspect, the light provided by the background light source flickers so that the light simulates flickering light provided by a fire.

In another aspect, the invention provides a flame simulating assembly for providing one or more image of flames. The flame simulating assembly includes a housing having a back wall with an exposed surface and defining a cavity open at a front end of the housing, and one or more light sources for producing the image of flames. The flame simulating assembly also includes a screen disposed in the cavity in front of the back wall and positioned in a path of light from the light source. The screen is adapted for transmission of the image of flames therethrough. In addition, the flame simulating assembly includes a first simulated fuel bed positioned in front of the screen and adjacent to a front surface of the screen, and a second simulated fuel bed positioned behind the screen and at least partially viewable through the screen. The screen includes a top edge spaced apart from a roof portion of the housing by at least one preselected distance to define an upper opening through which at least part of the exposed surface of the back wall is observable.

In yet another of its aspects, the invention provides a flame simulating assembly for providing one or more images of flames. The flame simulating assembly includes a housing having a back wall with an exposed surface and defining a cavity open at a front end of the housing, and one or more light sources for producing the image of flames. The flame simulating assembly also includes a screen disposed in the cavity in front of the back wall and positioned in a path of light from the light source. The screen is adapted for transmission of the image of flames therethrough. The flame simulating assembly additionally includes a simulated fuel bed positioned in front of the screen and adjacent to the front surface. The screen has a top edge spaced apart from a roof portion of the housing by at least one preselected distance to define an upper opening through which at least part of the exposed surface of the back wall is observable. Also, the flame simulating assembly includes one or more background light sources for at least partially illuminating part of the exposed surface of the back wall.

In another of its aspects, the invention provides a flame simulating assembly for providing one or more images of flames. The flame simulating assembly includes one or more light sources for producing the image of flames and a screen with a front surface and positioned in a path of light from the light source. The screen is adapted for transmission of the image of flames therethrough. The flame simulating assembly additionally includes one or more simulated interior fireplace walls positioned behind the screen. The screen is adapted to permit observation of at least part of the simulated interior fireplace wall. Also, the flame simulating assembly includes a simulated fuel bed with at least one first portion positioned adjacent to the front surface of the screen, and at least one second portion positioned behind the screen. The second portion is at least partially viewable through the screen.

BRIEF DESCRIPTION OF THE DRAWINGS

The invention will be better understood with reference to the drawings, in which.

DETAILED DESCRIPTION

Figure 1:
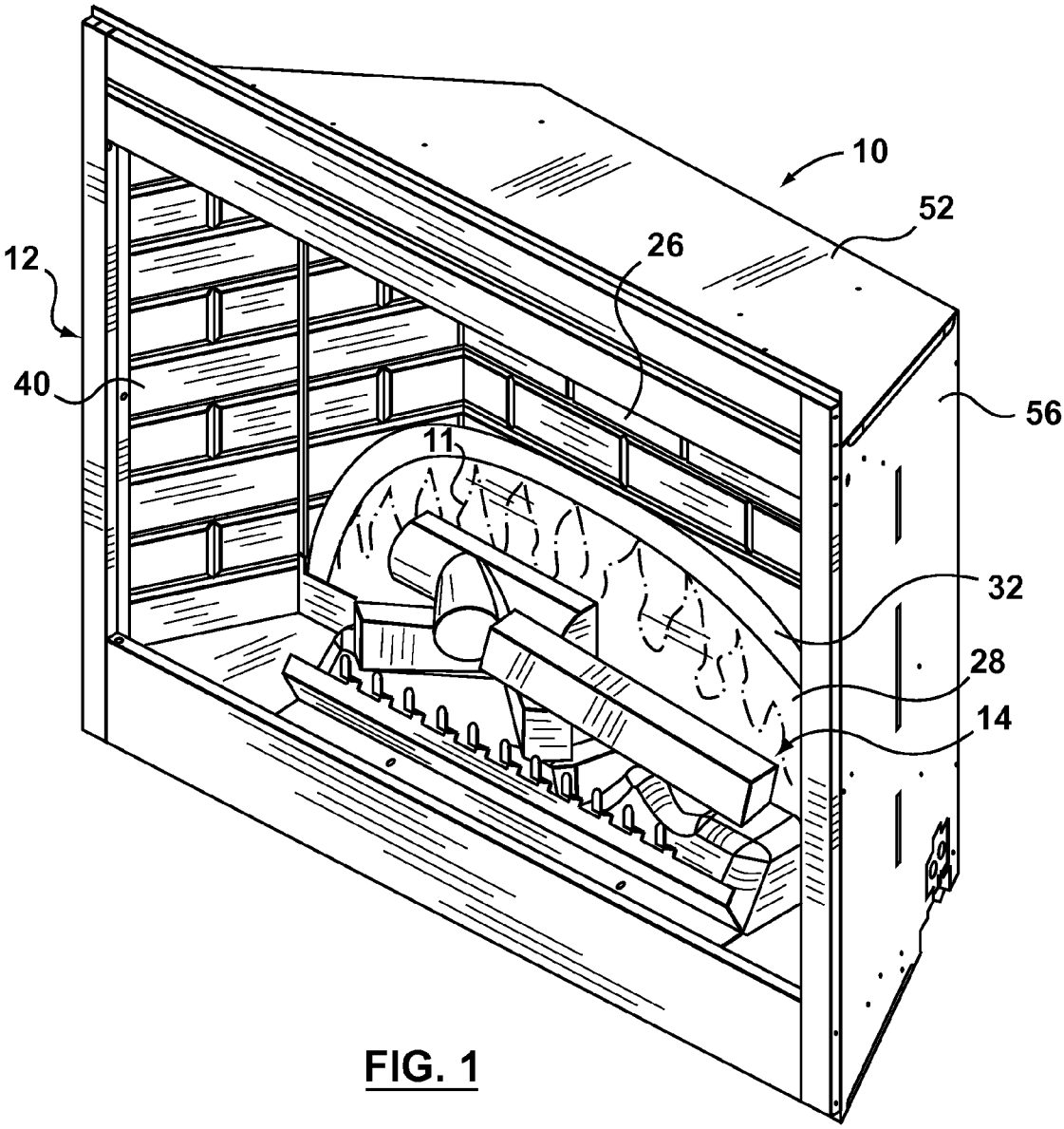
FIG. 1 is an isometric view of a preferred embodiment of the flame simulating assembly including a simulated fuel bed and a screen positioned behind the simulated fuel bed.
Figure 2A:
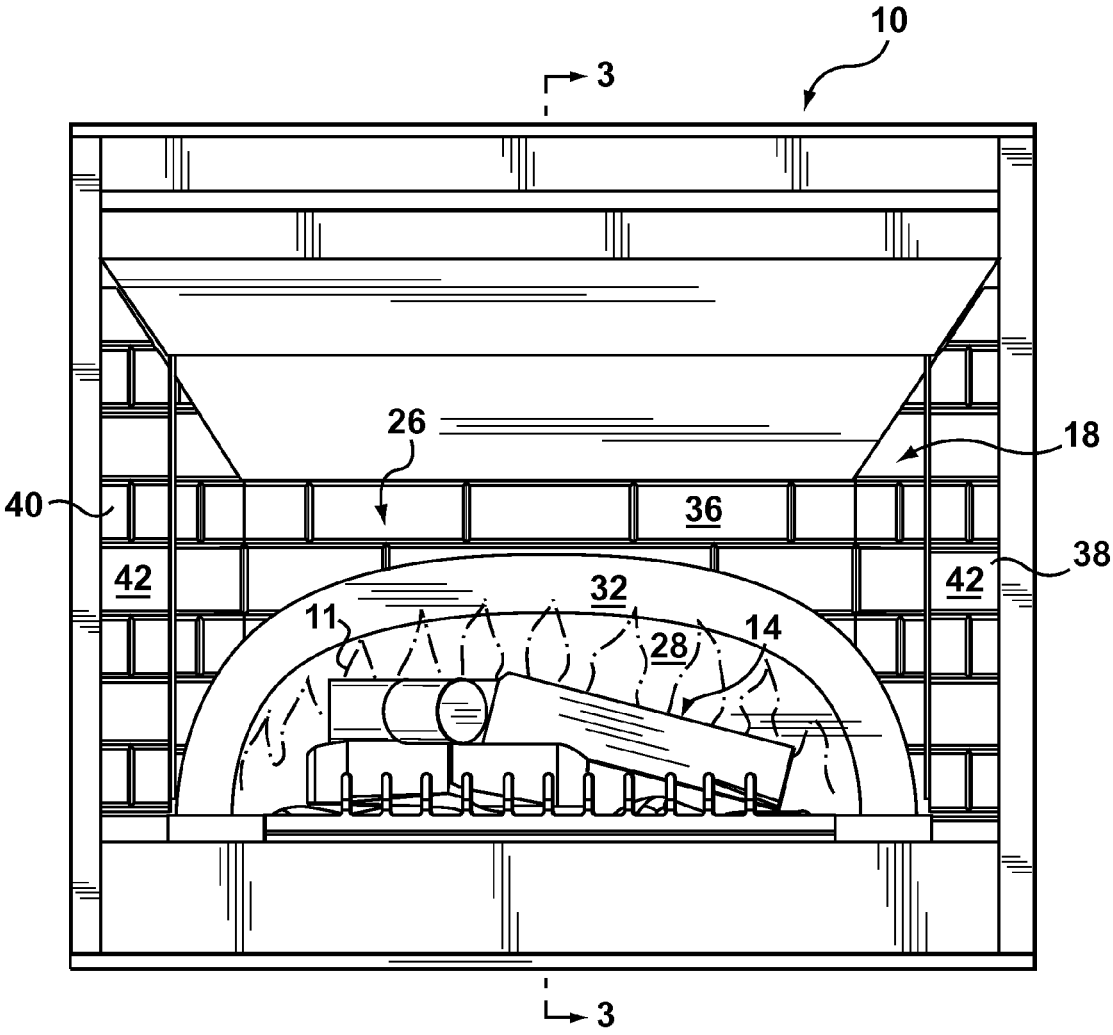
FIG. 2A is a front view of the flame simulating assembly of FIG. 1.
Figure 2B:
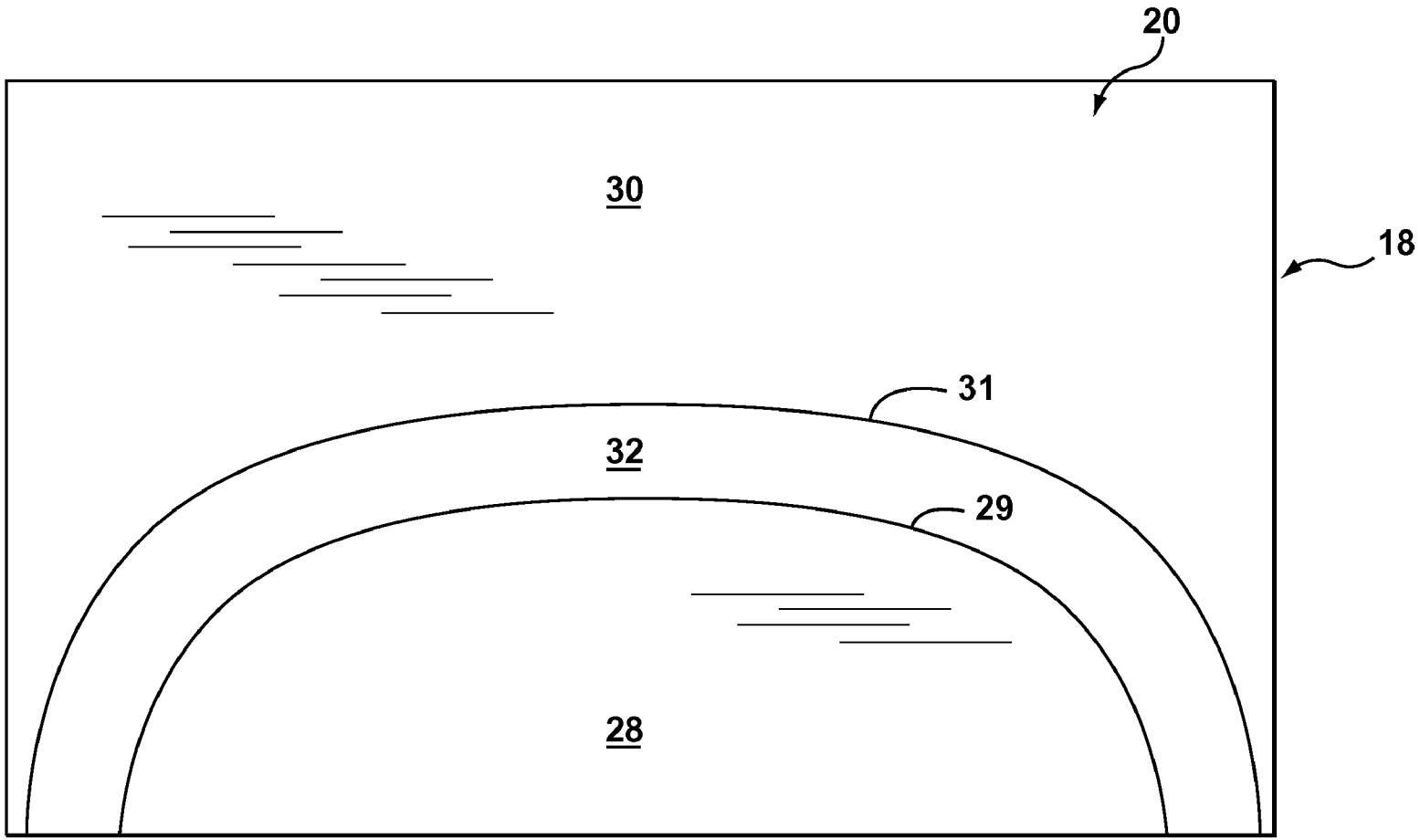
FIG. 2B is a front view of the screen.
Figure 2C:
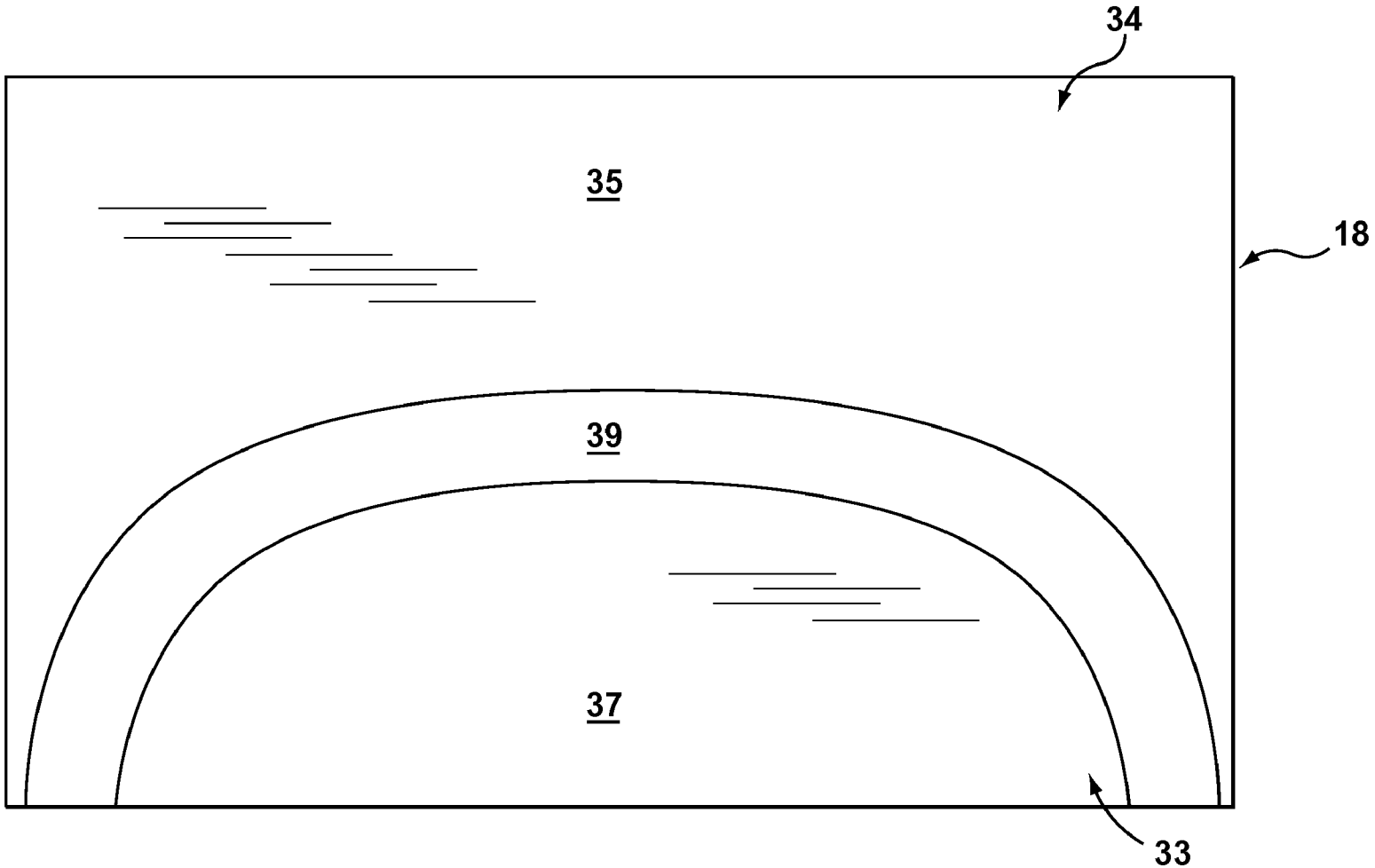
FIG. 2C is a back view of the screen.
Figure 3A:
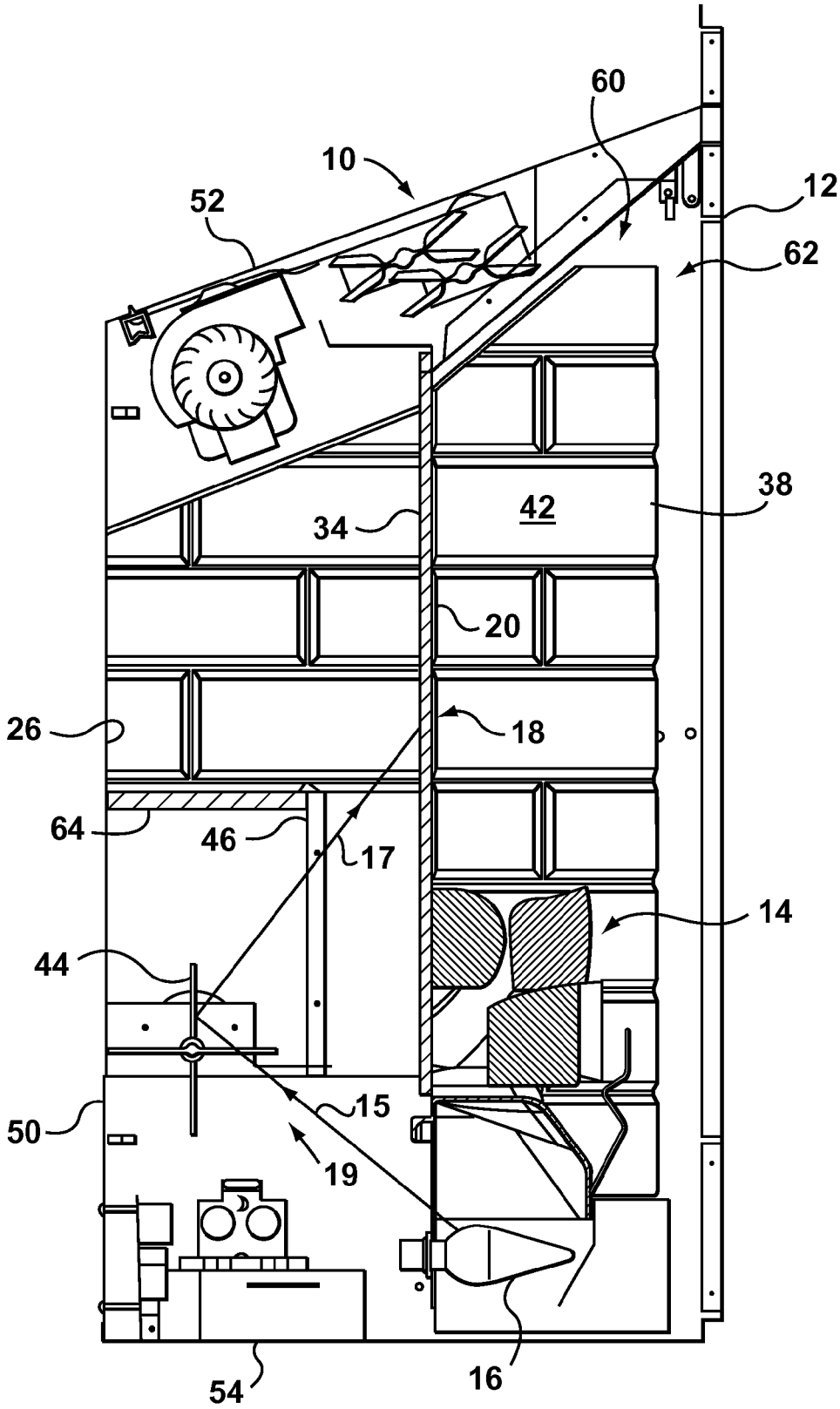
FIG. 3A is a cross section of the flame simulating assembly of FIG. 1 taken along line 3-3 in FIG. 2A, drawn at a larger scale.

Reference is first made to FIGS. 1, 2A, 2B, 2C and 3A to describe a preferred embodiment of a flame simulating assembly indicated generally by the numeral 10 in accordance with the invention. The flame simulating assembly 10 is for providing one or more images of flames 11 (FIGS. 1, 2A). Preferably, the flame simulating assembly 10 includes one or more light sources 16 for producing the images of flames 11, and a screen 18 positioned in a path of light 19 (schematically represented by arrows 15, 17 in FIG. 3A) from the light source. As can be seen in FIG. 3A, the screen 18 has a front surface 20. The screen 18 is adapted to transmit the images of flames 11 through the front surface 20. Preferably, the flame simulating assembly 10 also includes a simulated interior fireplace wall 26 which is positioned behind the screen 18, as can be seen in FIGS. 1, 2A, and 3A. In the preferred embodiment, the front surface 20 of the screen 18 includes an observation region 30 (FIGS. 2A, 2B). The observation region 30 is adapted to permit observation of at least part of the simulated interior fireplace wall 26. The front surface 20 of the screen 18 also includes a viewing region 28 (FIGS. 1, 2A, 2B).

For clarity, an image of flames 11 is illustrated in FIGS. 1, 2A, 4, and 5 in ghost outline. It will be understood that the image of flames is constantly changing (in shape and intensity of light, and color) while the flame simulating assembly 10 is operating.

As can be seen in FIGS. 1, 2A, and 3A, the flame simulating assembly 10 preferably includes a simulated fuel bed 14 which is positioned adjacent to the viewing region 28. In the preferred embodiment, the images of flames 11 are transmitted through the front surface 20 proximal to the simulated fuel bed 14, for a realistic flame simulation effect (FIGS. 1, 2A, 3A).

Preferably, the viewing region 28 is partially reflective. Because of this, the simulated fuel bed 14 is reflected in the viewing region 28 to an extent sufficient to provide an illusion of depth, as described in U.S. Pat. No. 5,642,580. U.S. Pat. No. 5,642,580 is hereby incorporated herein by reference.

However, the images of flames 11 are also transmittable through the partially reflective viewing region 28. As can be seen in FIGS. 1 and 2A, the viewing region 28 is located proximal to the simulated fuel bed 14 so that, when images of flames 11 are transmitted through the screen 18, the images of flames 11 appear to be rising from and out of the simulated fuel bed 14, similar to flames in a real fire. At the same time, the simulated interior fireplace wall 26 is observable through an observation region 30, thereby simulating a firebox in a real fireplace (not shown) in which wood or coal may be burned. The observation region 30 is preferably transparent or translucent, or at least partially transparent or translucent.

In the preferred embodiment, the front surface 20 of the screen 18 also includes a transition region 32 disposed between the viewing region 28 and the observation region 30. Preferably, the images of flames 11 are at least partially transmittable through the transition region 32, and the simulated interior fireplace wall 26 is also at least partially observable through the transition region 32. The transition region 32 is for providing a relatively gradual transition from the viewing region 28 to the observation region 30, in order to provide a more realistic overall simulation effect. Preferably, if the viewing region 28 is partially reflective, then the transition region 32 is also partially reflective, however, to a somewhat lesser extent. To achieve this, the transition region 32 is preferably less silvered relative to the viewing region 28, as will be described.

In the preferred embodiment, the screen 18 additionally includes a back surface 34 positioned opposite to the front surface 20. Preferably, the back surface 34 is adapted to diffuse light transmitted through the screen 18 to prevent an observer (not shown) from observing the light source 16, or other internal components of the flame simulating assembly 10. Such a back surface 34 is described in U.S. Pat. No. 5,642,580. In the preferred embodiment of the flame simulating assembly 10, however, the back surface 34 of the screen 18 includes a diffusing portion 33 which is located substantially opposite to the viewing region 28 and the transition region 32 (FIG. 2C). The back surface 34 also includes a non-diffusing portion 35 which is located substantially opposite to the observation region 30 (FIG. 2C).

In the preferred embodiment, the diffusing portion 33 is divided into a first part 37, located opposite to the viewing region 28, and a second part 39, located opposite to the transition region 32. Preferably, the extent to which light is diffused by the second part 39 is somewhat less than the extent to which light is diffused by the first part 37. Because of this, the simulated interior fireplace wall 26 is at least partially observable through the transition region 32.

Preferably, the screen 18 is glass, plastic, or another other suitable material. In the preferred embodiment, the screen 18 is lightly silvered so that it is partially reflective, to provide a two-way mirror in the viewing region 28. The transition region 32 is preferably more lightly silvered. Within the transition region 32, the extent of reflective material on the front surface 20 varies from a relatively greater amount closer to the viewing region 28 to a relatively lesser amount closer to the observation region 30. This variation within the transition region 32 is for providing a gradual decrease in reflective material, from the viewing region 28 to the observation region 30, to enhance the simulation effect provided by the flame simulating assembly 10. The preferred method of producing the viewing region 28, the observation region 30, and the transition region 32 will be described.

Alternatively, however, the screen 18 could be suitably tinted or otherwise treated in any suitable manner to provide the described simulation effect. For example, the screen could be tinted (i.e., without silvering on the front surface 20) to provide the viewing region 28 and the transition region 32, so that the viewing region 28 is darker than the transition region 32. The observation region 30 could also be tinted or screened to achieve any desired effects, but still permitting relatively unobstructed observation therethrough.

An upper edge 29 of the viewing region 28 (which is also a lower edge 29 of the transition region 32), is shown in FIG. 2B. Also, an upper edge 31 of the transition region 32 (which is also a lower edge 31 of the observation region 30) is shown in FIG. 2B. It will be understood that, in the preferred embodiment, the regions 28, 32, and 30 are not sharply distinguished from each other. The edges 29, 31 are shown as clearly distinguished lines for illustrative purposes. In the preferred embodiment, the change from the viewing region 28 to the transition region 32 is gradual, and the change from the transition region 32 to the observation region 30 is also gradual.

It is also preferred that the simulated interior fireplace wall 26 has a pattern 36 simulating firebrick thereon (FIGS. 1, 2A, 3A). The firebrick pattern 36 preferably resembles firebrick in walls of a firebox in a real fireplace, and tends to enhance the overall simulation effect.

Preferably, the flame simulating assembly 10 also includes a flame effect element 46, for configuring light from the light source 16 to form the image of flames 11. The flame effect element 46 is positioned in the path of light 19 from the light source 16 between the light source 16 and the screen 18. The flame effect element 46 can include one or more apertures (not shown) passing through the apertures forming into the image of flames 11 (FIG. 3A). A similar flame effect element is described in U.S. Pat. No. 5,642,580 and in U.S. Pat. No. 6,363,636. U.S. Pat. No. 6,363,636 is hereby incorporated herein by reference.

In the preferred embodiment, the flame simulating assembly 10 also includes a flicker element 44 for causing light from the light source 16 to fluctuate, thereby enhancing the overall simulation effect. The flicker element 44 is positioned in the path of light 19 from the light source 16 between the light source 16 and the screen 18. Preferably, the flicker element 44 is similar to the flicker elements described in U.S. Pat. Nos. 5,642,580 and 6,363,636.

In the preferred embodiment, the flame simulating assembly 10 includes a housing 48 with a substantially vertical back wall 50, a top wall 52, a bottom wall 54, and at least two side walls 56, 58 extending between the top and bottom walls 52, 54, defining a cavity 60 therein. The cavity 60 has an opening 62 at a front end 12 of the housing 48, so that the cavity 60 is substantially viewable from the front by the observer. The simulated interior wall 26 is preferably proximal to the back wall 50. Preferably, the simulated fuel bed 14 is disposed in the cavity 60 proximal to the opening 62. As shown in FIG. 3A, the screen 18 is positioned behind the simulated fuel bed 14 and in front of the interior wall 26.

As can be seen in FIGS. 1, 2A and 3A, the flame simulating assembly 10 preferably also includes two simulated interior fireplace sidewalls 38, 40. Each of the simulated interior fireplace sidewalls 38, 40 extends from the simulated interior wall 26 forwardly beyond the front surface 20 of the screen 18.

In the preferred embodiment, the interior element 26 has a pattern 36 simulating firebrick in the firebox of a real fireplace thereon. Preferably, the simulated interior fireplace sidewalls 38, 40 also have patterns 42 simulating firebrick thereon. In the preferred embodiment, the patterns 42 on the simulated interior fireplace sidewalls 38, 40 are positioned to be aligned with the pattern 36 on the interior element 26.

Although the pattern 36 and the patterns 42 are simulated firebrick (FIGS. 1 and 2A), various patterns could be used on the interior element 26 and the interior sidewalls 38, 40. As will be appreciated by those skilled in the art, various patterns could be used to achieve different simulating effects.

In use, the flicker element 44 causes light from the light source 16 to fluctuate upon reflection thereof by the flicker element 44. In the preferred embodiment, light from the light source 16 reflected by the flicker element 44 and thereby caused to fluctuate, or flicker, is configured by the flame effect element 46 to form one or more images of flames 11 transmitted through the screen 18. The images of flames 11 appear to be rising from the simulated fuel bed 14, and the observer also can simultaneously observe the simulated interior fireplace wall 26. The transition region 32 provides a relatively gradual transition between the viewing region 28 and the observation region 30, to enhance the simulation effect.

Figure 10:
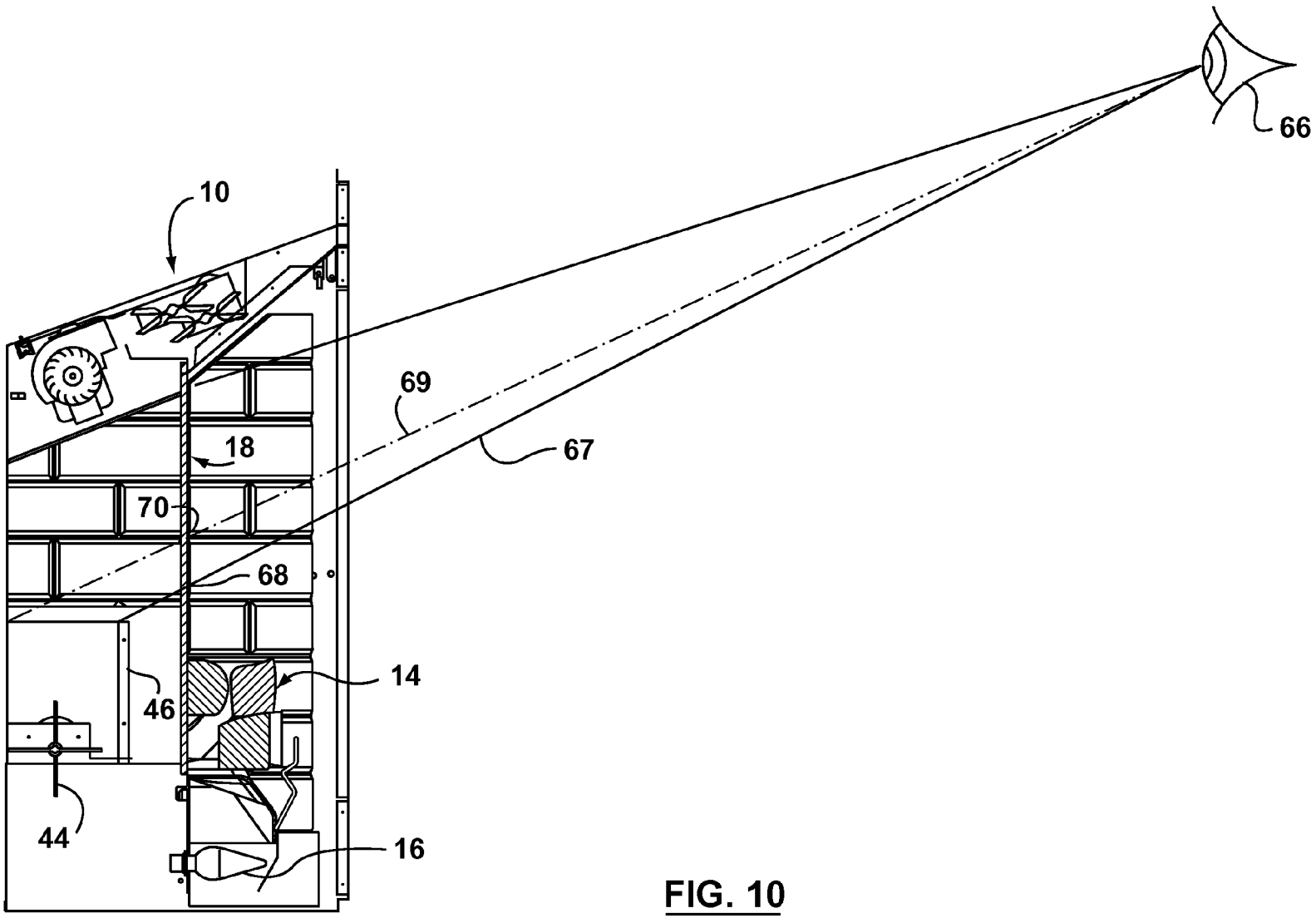
FIG. 10 is a cross section of the flame simulating assembly of FIG. 3A, drawn at a smaller scale.

Referring to FIG. 10, an eye 66 of an observer (not shown) is typically positioned so that a lower extent of the observer's field of vision (schematically represented by a line 67) intersects the screen 18 at 68. In FIG. 10, the lower edge 29 of the transition region 32 (i.e., the upper edge 29 of the viewing region 28) (FIG. 2B) is preferably located substantially at 68 on the front surface 20 of the screen 18. Similarly, an approximate middle of the observer's field of vision (schematically represented by a line 69) intersects the screen 18 at 70. In the preferred embodiment, the lower edge 31 of the observation region 30 (i.e., the upper edge 31 of the transition region 32) (FIG. 2B) is preferably located at 70 on the front surface 20 of the screen 18. The positioning of the edges 29, 31 of the regions 28, 30, 32 on the front surface 20 can be varied to suit the relative positioning of the screen 18 and the internal components in a flame simulating assembly 10, and in accordance with an assumed relative positioning (or range of positions) of the observer.

If preferred, the flame simulating assembly 10 optionally includes a shield 64, for obstructing light from the light source 16 which is directed to the vicinity of the observation region 30 or for concealing certain components. The shield 64 is preferably positioned behind the screen 18 and below the transition region 32 and beside or below the transition region 32. As can be seen in FIG. 10, an observer's eye 66 observing the flame simulating assembly 10 is typically positioned so that the observer cannot observe the flame effect element 46 or other components positioned behind the screen 18 directly. However, it is possible that an observer (not shown) could be positioned so as to view some of the internal components (such as the flicker element 44, or the flame effect element 46) directly, or light from the light source 16 directed to the observation region 30 may distract the observer. In either or both of these circumstances, it may be advantageous to include the shield 64 in the flame simulating assembly 10. A preferred embodiment of the shield 64 is shown in FIG. 3A.

However, it has been found that, if the components are positioned appropriately relative to each other and relative to the observation region 30 and the transition region 32, the shield 64 is generally not necessary. As can be seen in FIG. 10, the positioning of the flame effect element 46 and the flicker element 44 relative to the transition region 32 and the observation region 30 can affect the effectiveness of the simulation provided by the flame simulating assembly 10. The flame effect element 46 and the flicker element 44 are preferably not positioned where the ordinarily located observer would be able to observe these components directly through the transition region 32 or the observation region 30.

Additional embodiments of the invention are shown in FIGS. 3B, 4, 5, 6A, 6B, 7-9 and 11-23. In FIGS. 3B, 4, 5, 6A, 6B, 7-9 and 11-23, elements are numbered so as to correspond to like elements shown in FIGS. 1, 2A, 2B, and 3A.

Figure 4:
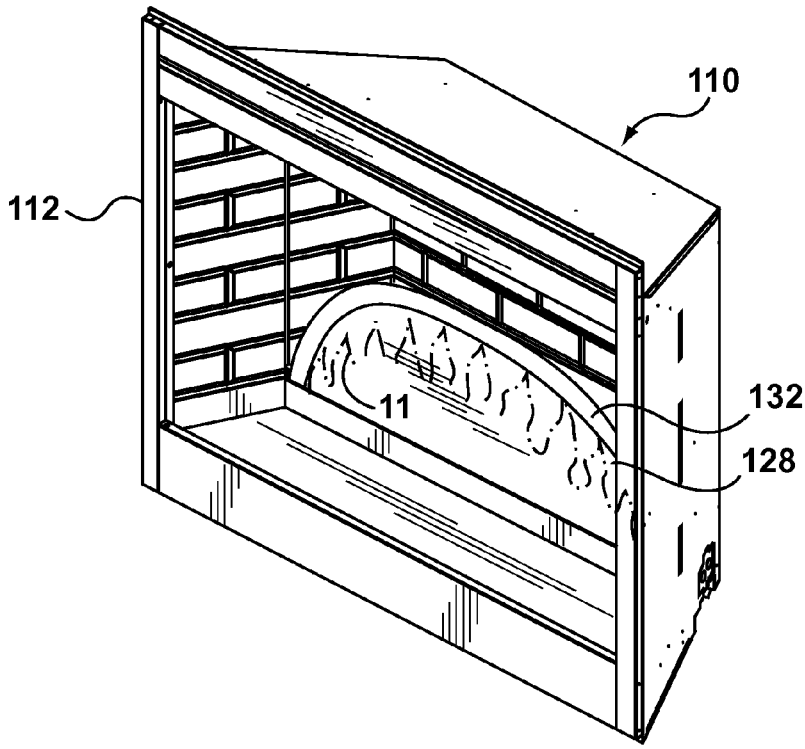
FIG. 4 is an isometric view of another embodiment of the flame simulating assembly of the invention, drawn at a smaller scale.
Figure 5:
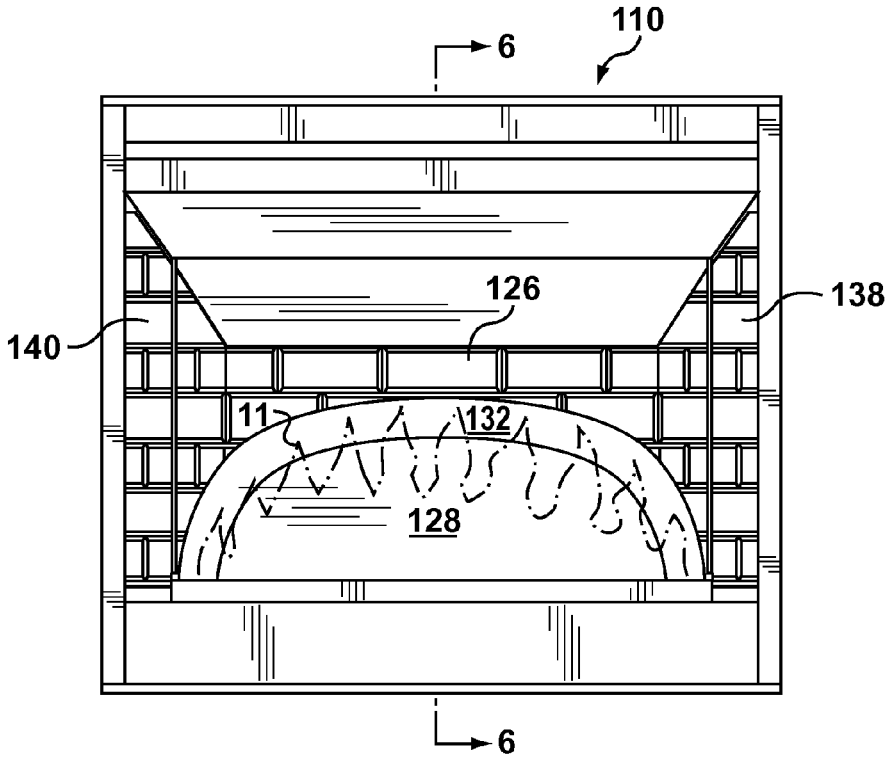
FIG. 5 is a front view of the flame simulating assembly of FIG. 4.
Figure 6A:
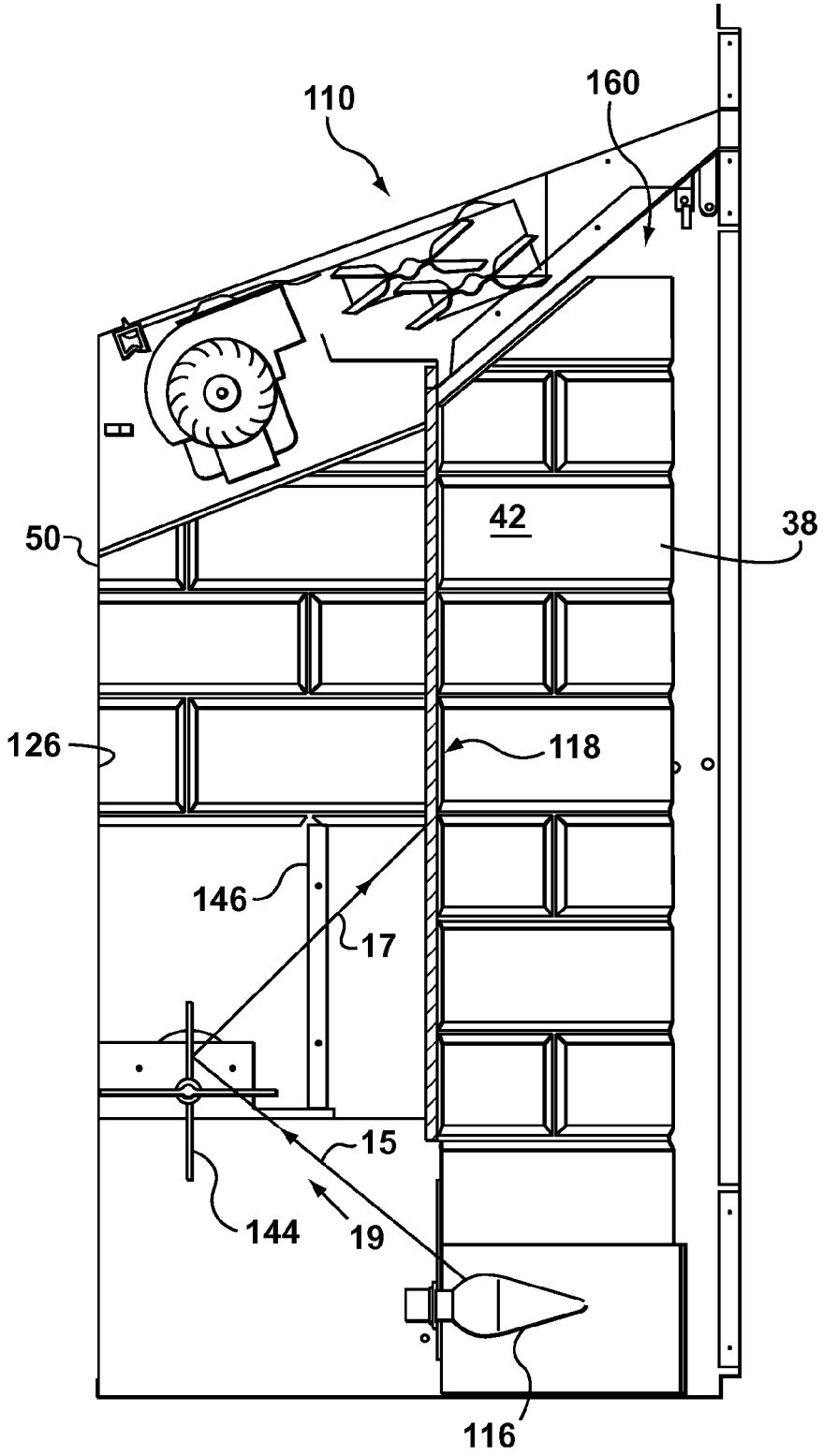
FIG. 6A is a cross section of the flame simulating assembly of FIG. 4 taken along line 6-6 in FIG. 5, drawn at a larger scale.

An alternative embodiment 110 of the flame simulating assembly is shown in FIGS. 4, 5 and 6A. The flame simulating assembly 110 does not include a simulated fuel bed, but is adapted for use with a simulated fuel bed (not shown) which is to be provided separately by a user (not shown). The simulated fuel bed, when provided, is to be located proximate to a front side 112 of the flame simulating assembly 110. The flame simulating assembly 110 includes a cavity 160, and also has a light source 116 for providing an image of flames 11 and the screen 18 positioned in the cavity 160. The flame simulating assembly 110 also includes the simulated interior fireplace wall 26 positioned behind the screen 18. The screen 18 includes the front surface 20 with the viewing region 28, the observation region 30, and the transition region 32 positioned between the viewing region 28 and the observation region 30. The viewing region 28 is positioned, at least in part, at the bottom of the screen 18—i.e., adjacent to the simulated fuel bed, once provided. The observation region 30 is positioned distal to the viewing region 28.

Because it does not include a simulated fuel bed, the flame simulating assembly 110 requires relatively less materials, and would be relatively less costly to construct. The user could use any materials chosen by the user as a simulated fuel bed. For example, real wooden logs (with or without a grate) could be used.

Although the flame simulating assembly 110 is adapted for use with a separate simulated fuel bed, the flame simulating assembly 110 also could be used without a simulated fuel bed, if the user so chose.

In the flame simulating assembly 110, the simulated interior fireplace wall 26 is preferably mounted on or positioned adjacent to the back wall 50. Also, the flame simulating assembly 110 preferably includes two simulated interior fireplace sidewalls 38, 40. Each of the simulated interior fireplace sidewalls 38, 40 extends from the simulated interior fireplace wall 26 forwardly beyond the front surface 20 of the screen 18. The simulated interior fireplace wall 26 preferably includes the pattern 36 simulating firebrick thereon. Preferably, the simulated interior fireplace sidewalls 38, 40 also have patterns 42 simulating firebrick thereon. It is preferred that the patterns 42 on the simulated interior fireplace sidewalls 38, 40 are positioned to be aligned with the pattern 36 on the back wall 26.

Figure 3B:
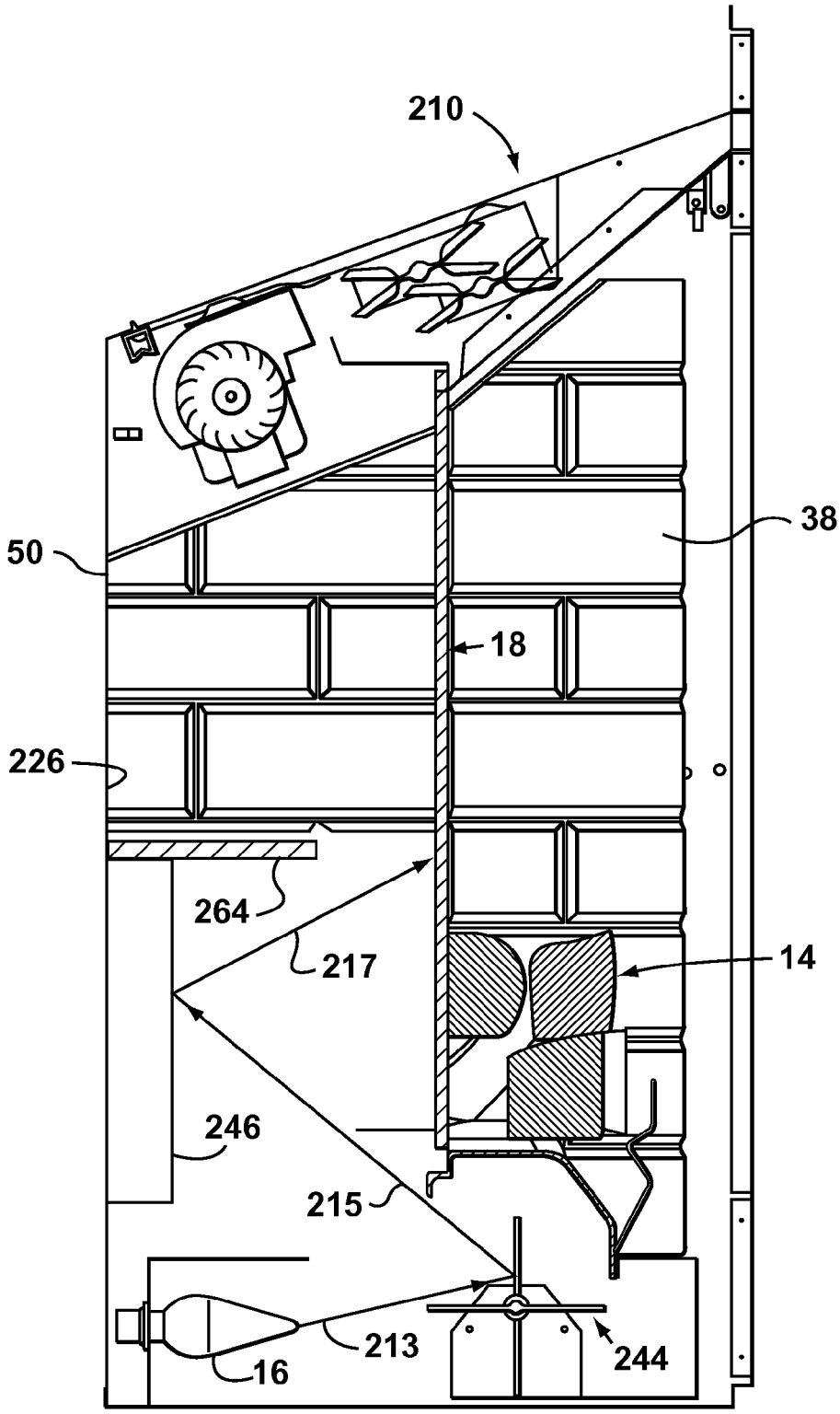
FIG. 3B is a cross section of an alternative embodiment of the flame simulating assembly of the invention.

In another alternative embodiment 210 of the flame simulating assembly of the invention, as can be seen in FIG. 3B, a flicker element 244 is positioned substantially underneath the simulated fuel bed 14. The flame simulating assembly 210 includes the housing 48, and a flame effect element 246 is mounted on or positioned proximal to the back wall 50. The flame effect element 246 is substantially reflective, and is preferably formed in the shape of flames. Preferably, the flame effect element 246 is similar to a flame effect element disclosed in U.S. Pat. No. 6,564,485. U.S. Pat. No. 6,564,485 is hereby incorporated herein by reference. Also, however, a simulated interior fireplace wall 226 is mounted proximal to the back wall 50, and in the vicinity of the flame effect element 246.

The flicker element 244 is positioned in a path of light 219 between the light source 16 and the screen 18. Similarly, the flame effect element 246 is positioned in the path of light 219 between the light source 16 and the screen 18. The path of light 219 is schematically represented by arrows 213, 215, and 217 (FIG. 3B).

The screen 18 in the flame simulating assembly 210 includes the viewing region 28, the observation region 30, and the transition region 32. The flicker element 244 causes light from the light source 16 to fluctuate upon reflection thereof by the flicker element 44. Light from the light source 16 which is reflected by the flicker element 44 and thereby caused to fluctuate, or flicker, is configured by the flame effect element 246 to form one or more images of flames 11 transmitted through the screen 18. The images of flames 11 appear to be rising from the simulated fuel bed 14, and the observer also can simultaneously observe the simulated interior fireplace wall 226. The transition region 32 provides a relatively gradual transition between the viewing region 28 and the observation region 30, to enhance the simulation effect. The positioning of the flicker element 244 substantially underneath the simulated fuel bed 14, and the positioning of the at least partially reflective flame effect element 246 proximal to, or on the back wall 50, results in an enhanced simulation effect.

Figure 11:
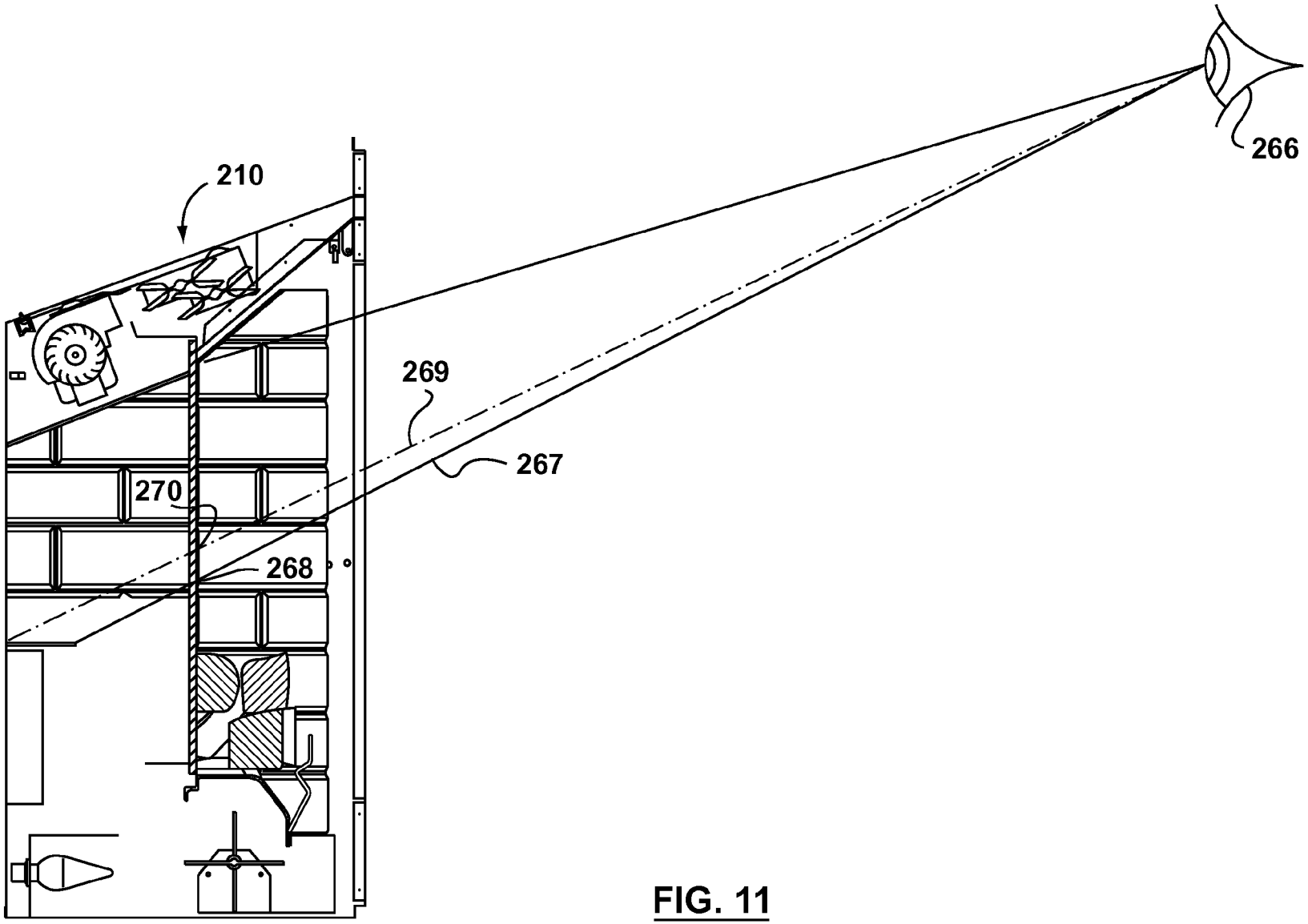
FIG. 11 is a cross section of the flame simulating assembly of FIG. 3B.

Referring to FIG. 11, an eye 266 of an observer (not shown) is typically positioned so that a lower extent of the observer's field of vision (schematically represented by a line 267) intersects the screen 18 at 268. In FIG. 11, the lower edge 29 of the transition region 32 (i.e., the upper edge 29 of the viewing region 28) (FIG. 2B) is preferably located substantially at 68 on the front surface 20 of the screen 18. Similarly, an approximate middle of the observer's field of vision (schematically represented by a line 269) intersects the screen 18 at 270. In the preferred embodiment, the lower edge 31 of the observation region 30 (i.e., the upper edge 31 of the transition region 32) (FIG. 2B) is preferably located on the front surface 20 of the screen 18. The positioning of the edges 29, 31 of the regions 28, 30, 32 on the front surface 20 can be varied to suit the relative positioning of the screen 18 and the internal components in a flame simulating assembly 210, and in accordance with an assumed relative positioning (or range of positions) of the observer.

If preferred, the flame simulating assembly 210 optionally includes a shield 264, for obstructing light from the light source 16 which is directed to the vicinity of the observation region 30 or for concealing certain components. The shield 264 is preferably positioned behind the screen 18 and beside or below the transition region 32. As can be seen in FIG. 11, an observer's eye 266 observing the flame simulating assembly 210 is typically positioned so that the observer cannot observe the flame effect element 246 or other components positioned behind the screen 18 directly. However, it is possible that an observer (not shown) could be positioned so as to view some of the internal components (such as the flicker element 244, or the flame effect element 246) directly, or light from the light source 16 directed to the observation region 30 may distract the observer. In either or both of these circumstances, it may be advantageous to include the shield 264 in the flame simulating assembly 210. A preferred embodiment of the shield 264 is shown in FIG. 3B.

However, it has been found that, if the components are positioned appropriately relative to each other and relative to the observation region 30 and the transition region 32, the shield 264 is generally not necessary. As can be seen in FIG. 11, the positioning of the flame effect element 246 and the flicker element 244 relative to the transition region 32 and the observation region 30 can affect the effectiveness of the simulation provided by the flame simulating assembly 210. The flame effect element 246 and the flicker element 244 are preferably not positioned where the ordinarily located observer would be able to observe these components directly through the transition region 32 or the observation region 30.

Figure 6B:
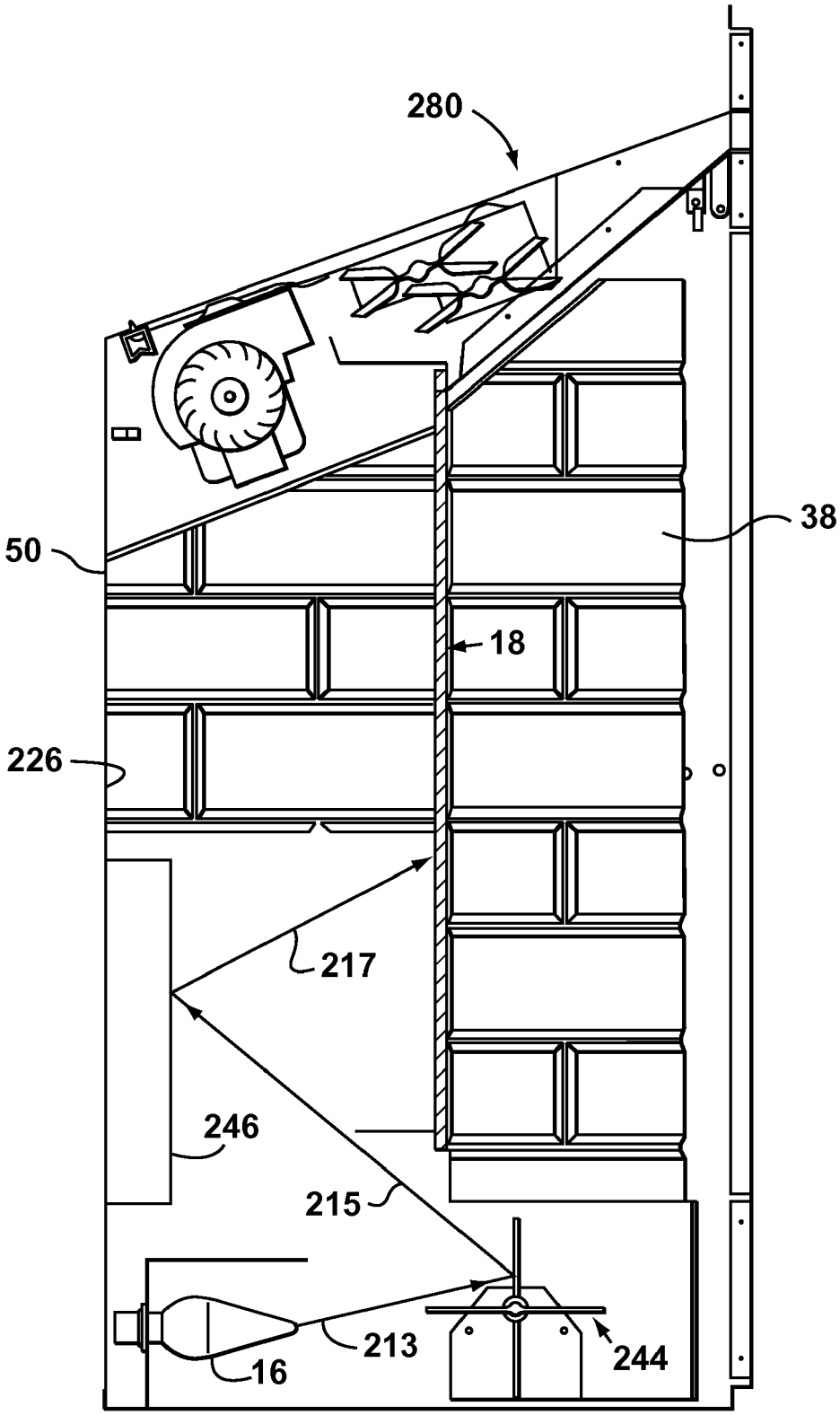
FIG. 6B is a cross section of another alternative embodiment of the flame simulating assembly of the invention.

In FIG. 6B, another alternative embodiment 280 of a flame simulating assembly of the invention is shown. The flame simulating assembly 280 is the same as the flame simulating assembly 210 shown in FIG. 3B, except that flame simulating assembly 280 does not include a simulated fuel bed. As in flame simulating assembly 110, the user can provide a simulated fuel bed or, if preferred, operate the unit without a simulated fuel bed. The flame simulating assembly 280 also is not shown as including the optional shield element.

Figure 12:
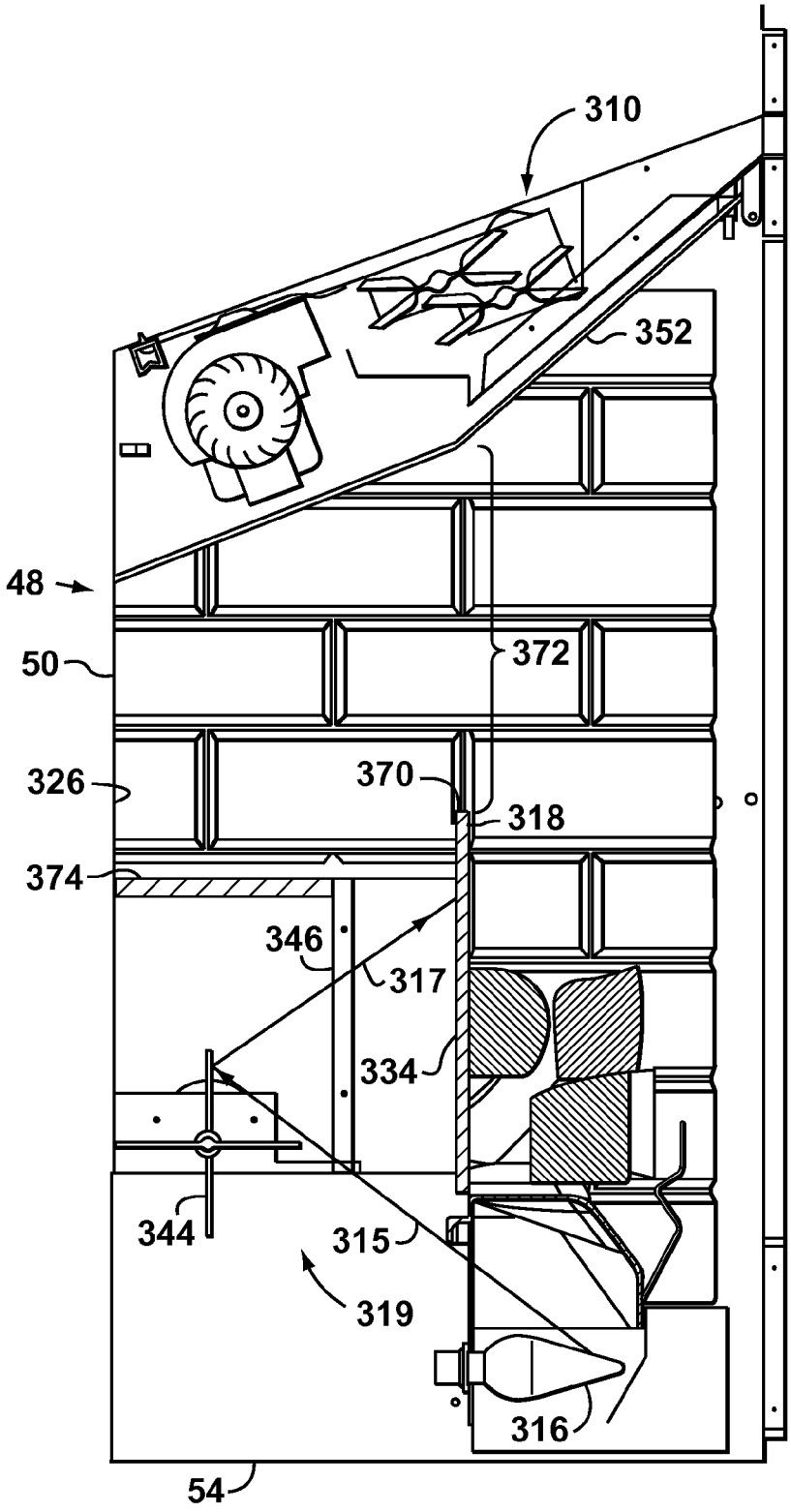
FIG. 12 is a cross section of an alternative embodiment of the flame simulating assembly including an alternative embodiment of the screen, drawn at a larger scale.
Figure 13:
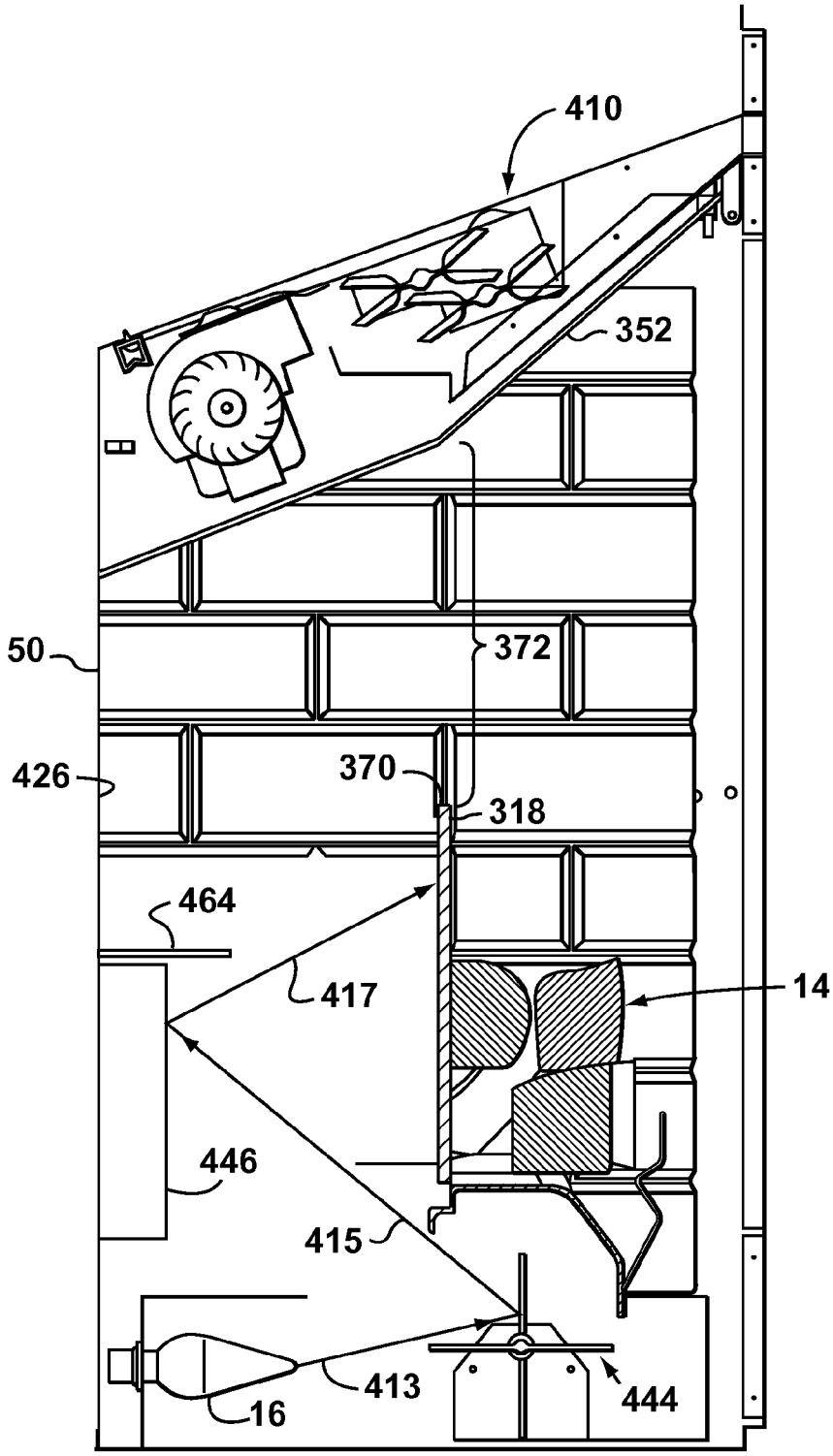
FIG. 13 is a cross section of another alternative embodiment of the flame simulating assembly including the alternative embodiment of the screen in the flame simulating assembly of FIG. 12.
Figure 14:
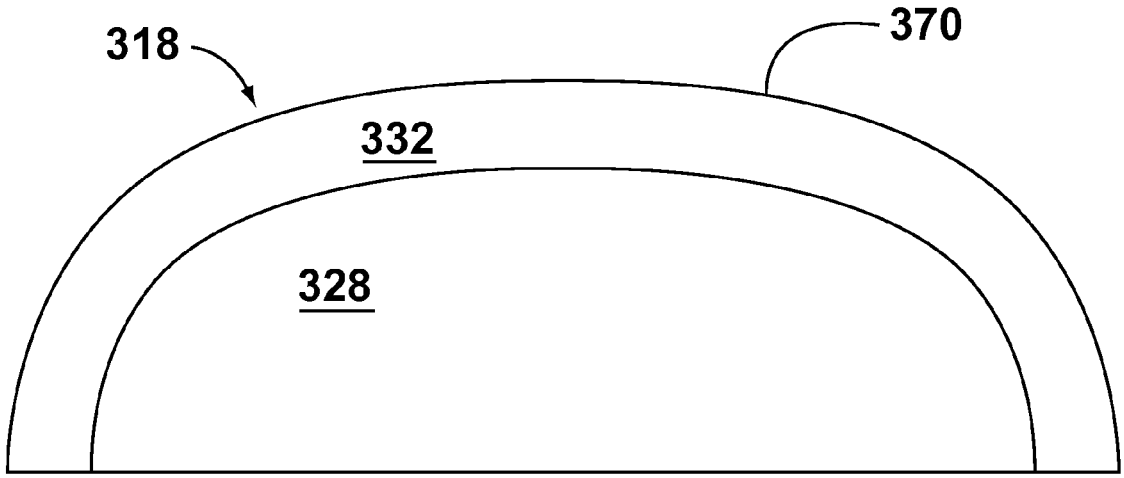
FIG. 14 is a front view of the alternative embodiment of the screen of FIGS. 12 and 13, drawn at a larger scale.

An alternative embodiment 318 of a screen is shown in FIGS. 12-14. As can be seen in FIG. 12, the screen 318 is included in an alternative embodiment of a flame simulating assembly 310. The flame simulating assembly 330 includes the housing 48, which includes the back wall 50, a top wall 352, a bottom wall 54, and at least two side walls 56, 58 extending between the top and bottom walls 352, 54. The flame simulating assembly 310 also includes a simulated interior fireplace wall 326 mounted on or positioned proximal to the back wall 50. The screen 318 is positioned behind the simulated fuel bed 14 and in front of the simulated interior fireplace wall 326.

As can be seen in FIG. 12, the flame simulating assembly 310 also includes a light source 316, a flicker element 344 positioned in a path of light 319 (schematically represented by arrows 315, 317), and a flame effect element 346, also positioned in the path of light 319. The flame effect element 346 is for configuring light from the light source 316 into one or more images of flames 11 which are transmitted through the screen 318. The flicker element 344 is for causing light from the light source to flicker or fluctuate, thereby enhancing the overall simulation effect.

As can be seen in FIGS. 12 and 14, the screen 318 extends upwardly to a top edge 370, located distal to the simulated fuel bed 14. The top edge 370 is spaced apart from the top wall 352 to form an upper opening 372 between the top wall 352 and the screen 318. Substantially unobstructed observation is thus permitted through the upper opening 372, so that the simulated interior fireplace wall 326 is observable. Because this is similar to the substantially unobstructed observation of a firebox which may be enjoyed by an observer of a real fireplace (i.e., one in which wood or coal may be burned), the upper opening 372 tends to enhance the overall simulation effect.

Optionally, a shield 374 (shown in FIG. 12) may be included in the flame simulating assembly 310. The shield 374 (similar to the shield 64, shown in FIG. 3A) is for obstructing light from the light source 16 which may be directed above the top edge 370 of the screen 318 or for concealing certain components. The shield 374 is preferably positioned behind the screen 318 and beside or below the transition region 332. It is possible that the observer could be positioned so as to view some of the internal components (such as the flicker element 344, or the flame effect element 346) directly, or light from the light source 16 directed above the top edge 370 of the screen 318 may distract the observer. In either or both of these circumstances, it may be advantageous to include the shield 374 in the flame simulating assembly 310. A preferred embodiment of the shield 374 is shown in FIG. 12.

However, it has been found that, if the internal components are positioned appropriately relative to each other and relative to the transition region 332 and the top edge 370, the shield 374 is generally not necessary. The flame effect element 346 and the flicker element 344 are preferably not positioned where the ordinarily located observer would be able to observe these components directly through the transition region 332 or the upper opening 372.

Preferably, the screen 318 includes a viewing region 328 and a transition region 332. In the preferred embodiment, the viewing region 328 is partially reflective, although the images of flames 11 are also transmittable through the viewing region 328. Also, the screen 318 preferably includes a transition region 332 extending from the viewing region 328 to the top edge 370. The transition region 332 is preferably lightly silvered (and therefore also partially reflective), so that the simulated interior fireplace wall 326 is at least partially viewable through the transition region 332. A back surface 334 of the screen 318 diffuses light from the light source 16, also to enhance the overall simulation effect. Also, however, the images of flames 11 are partially observable through the transition region 332.

Alternatively, the viewing region 332 is translucent. For example, the screen 318 could be suitably tinted glass or plastic (or other suitable material) through which the image of flames 11 is transmittable. The transition region 332 also could be suitably tinted, to enhance the overall simulation effect.

Another alternative embodiment of a flame simulating assembly 410 of the invention, shown in FIG. 13, includes the screen 318. In the flame simulating assembly 410, a flicker element 444 is positioned substantially underneath the simulated fuel bed 14. The flame simulating assembly 410 includes the housing 48, and a flame effect element 446 is mounted on or positioned proximal to the back wall 50. The flame effect element 446 is preferably reflective (or substantially reflective), and is preferably formed in the shape of flames. Preferably, the flame effect element 446 is similar to a flame effect element disclosed in U.S. Pat. No. 6,564,485. Also, however, a simulated interior fireplace wall 426 is mounted proximal to the back wall 50, and in the vicinity of the flame effect element 446.

The flicker element 444 is positioned in a path of light 419 between the light source 16 and the screen 318. Also, the flame effect element 446 is positioned in the path of light 419 between the light source 16 and the screen 318. The path of light 419 is schematically represented by arrows 413, 415, and 417 (FIG. 13).

The positioning of the flicker element 444 substantially underneath the simulated fuel bed 14, and the positioning of the flame effect element 446 proximal to or on the back wall 50, results in an enhanced simulation effect. Preferably, the flame simulating assembly 410 includes a shield 464 for obstructing light from the light source directed above the screen 318.

Figure 7:
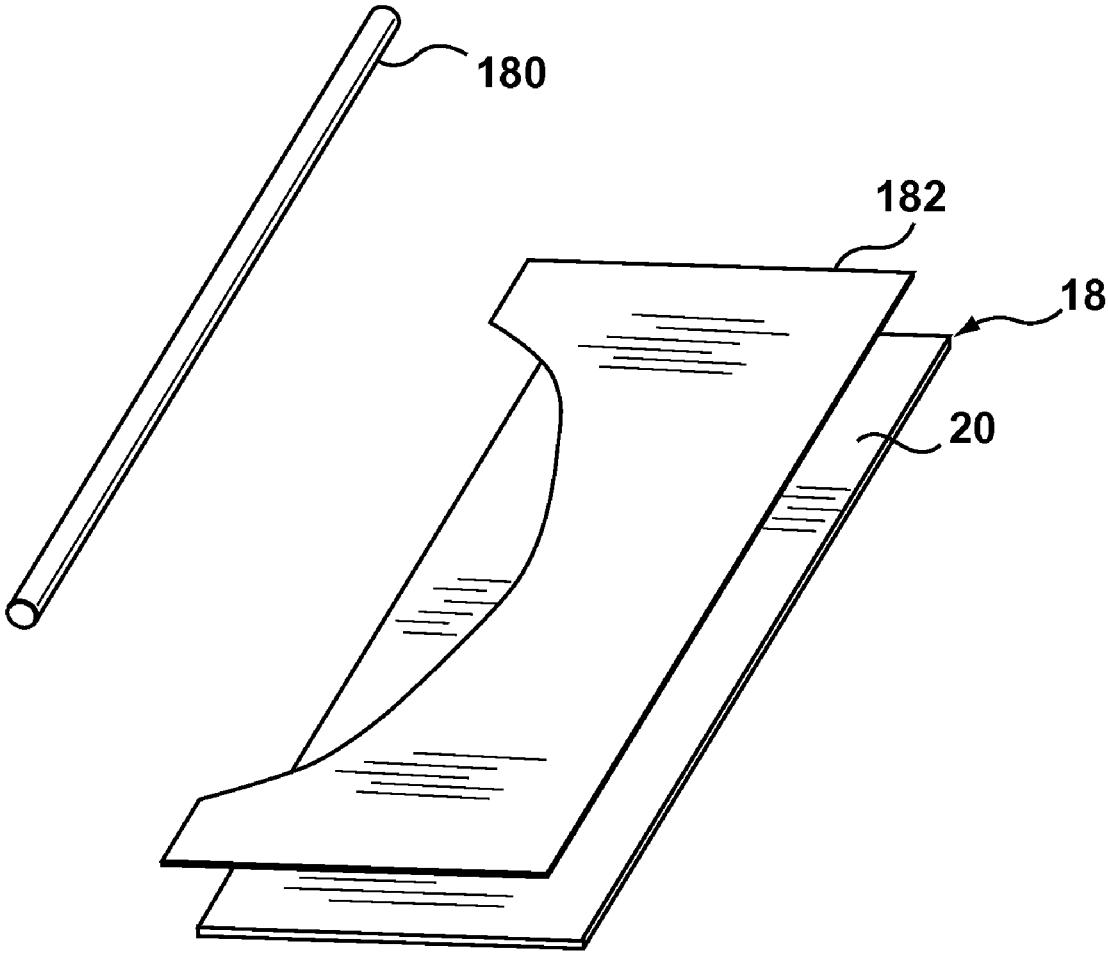
FIG. 7 is an isometric view of a screen having a front surface, with a mask element and a source of vaporized metal positioned relative to each other and to the front surface.
Figure 8:
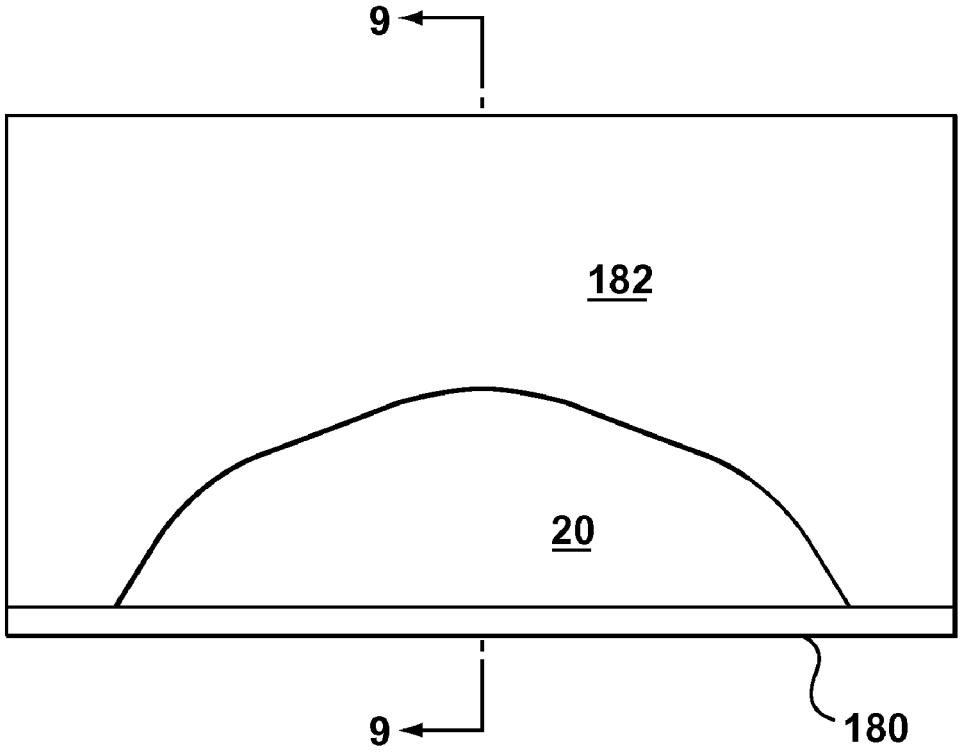
FIG. 8 is a front view of the screen, the mask element, and the source of FIG. 7, drawn at a larger scale.
Figure 9:
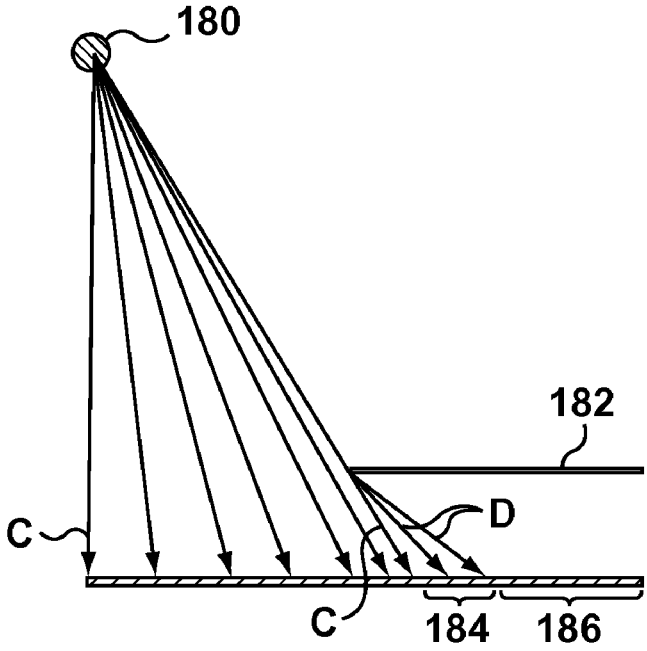
FIG. 9 is a cross section of the screen, the mask element, and the source of FIG. 8 taken along line 8-8 in FIG. 7.

The translucent portion 28 and the transition portion 32 on the front surface 12 of the screen 18 are preferably partially reflective, and are preferably created as follows. As shown in FIG. 7, a source 180 of vaporized metal (not shown) adapted for spraying vaporized metal onto the front surface 20 is provided. Also, a mask element 182 is provided, to substantially prevent vaporized metal sprayed from the source 180 from condensing on the transparent portion 32 of the front surface 20. The mask element 182 is positioned in a predetermined mask position relative to the source 180 and the front surface 20, as shown in FIGS. 7-9. The source 180 is also positioned in a predetermined source position relative to the mask element 182 and the front surface 20 so that vaporized metal is sprayable from the source 180 onto the translucent portion 28 and the transition portion 32 of the front surface 20.

The path of the vaporized metal sprayed from the source 180 onto the front surface 20 is schematically shown by arrows C and D in FIG. 9. The arrows identified as C in FIG. 9 represent metal vapor which is sprayed directly onto the front surface 20 to form the translucent portion 28. The arrows identified as D in FIG. 9 represent the metal vapor which is distributed over a portion of the front surface 20 to form the transition portion 32. As can be seen in FIG. 9, the transition portion 32 is in an area 184 on which vaporized metal condenses, spread out so that its concentration is not as great as in the translucent portion because the mask element 182 prevents spraying of the vaporized metal directly onto the area 184. As can be seen in FIG. 9, the mask element 182 also prevents vaporized metal from condensing in the transparent portion 30, formed in an area 186.

Preferably, the screen 18, 118 comprises glass. Alternatively, a suitable polycarbonate (such as plexiglas) or a suitable acrylic material can be used.

The vaporized metal is preferably produced by passing a relatively high electric current through a suitably prepared metal, such as aluminium. As is known in the art, the high current vaporizes the metal, i.e., changes the metal so that it is in a gaseous state. The vaporized metal can then be sprayed onto a surface which is at a lower temperature (e.g., the surface 20, at room temperature), causing the rapid "condensation" (i.e., solidification) of the vaporized metal on the cooler surface.

Alternatively, some or all of the viewing region 28 can be formed using silvered film, attached to the front surface by any suitable means. For example, where the viewing region includes silvered film, the transition region could be formed by spraying suitable materials onto the front surface. Alternatively, both the viewing region 28 and the transition region 32 could be formed using silvered film.

Figure 15:
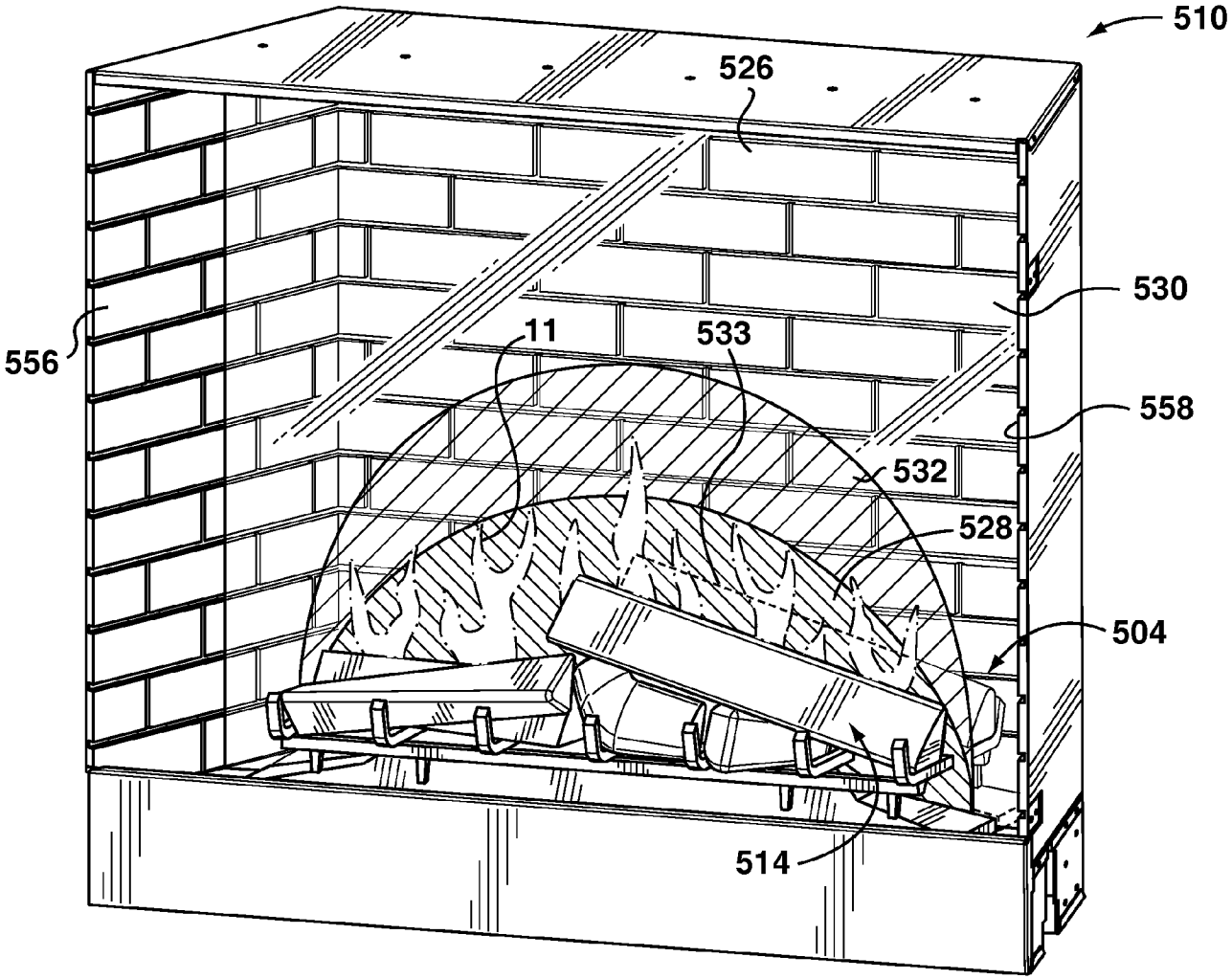
FIG. 15 is an isometric view of another embodiment of the flame simulating assembly of the invention.
Figure 17:
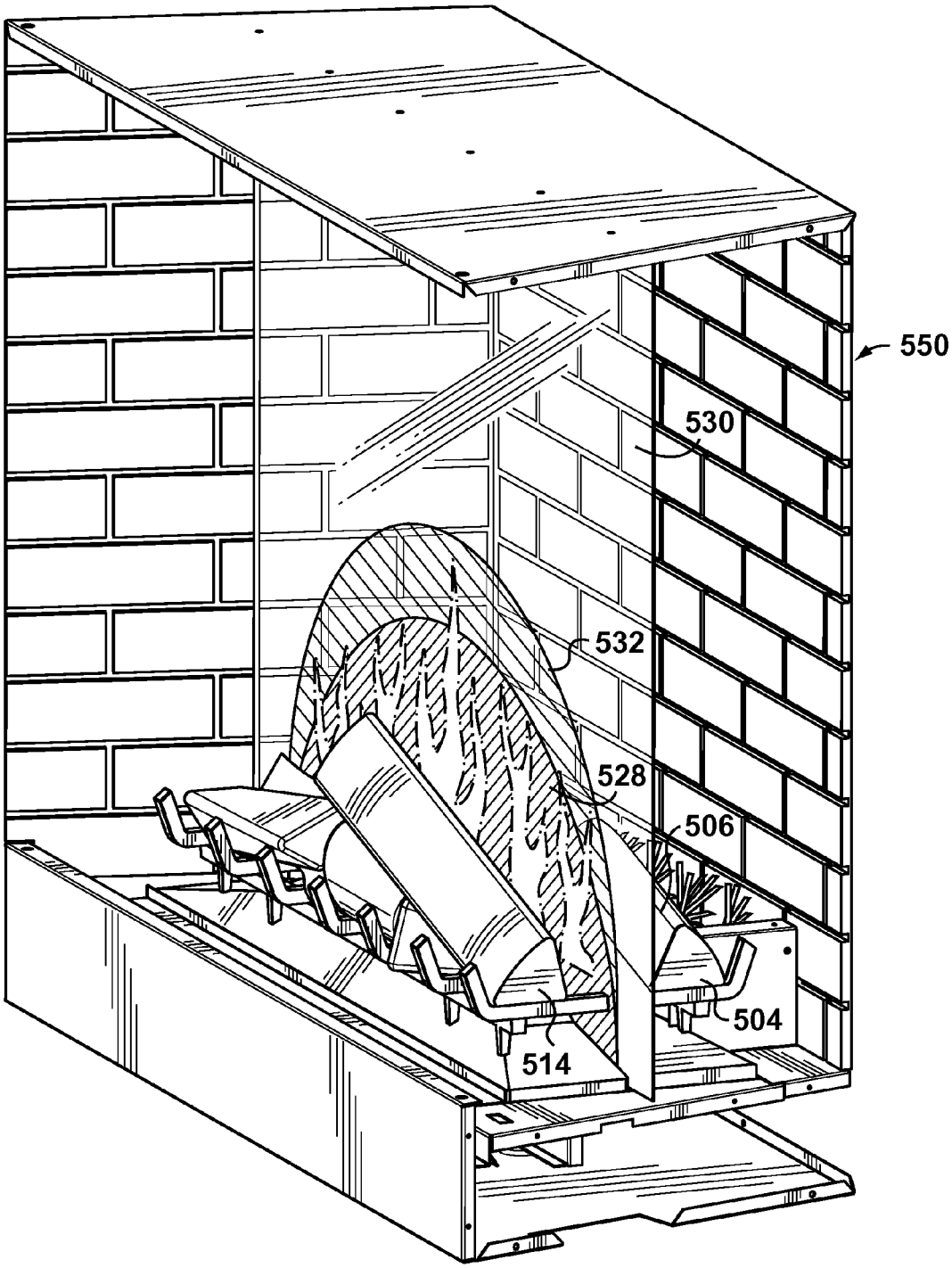
FIG. 17 is another isometric view, partially cut away, of the flame simulating assembly of FIG. 15.
Figure 18:
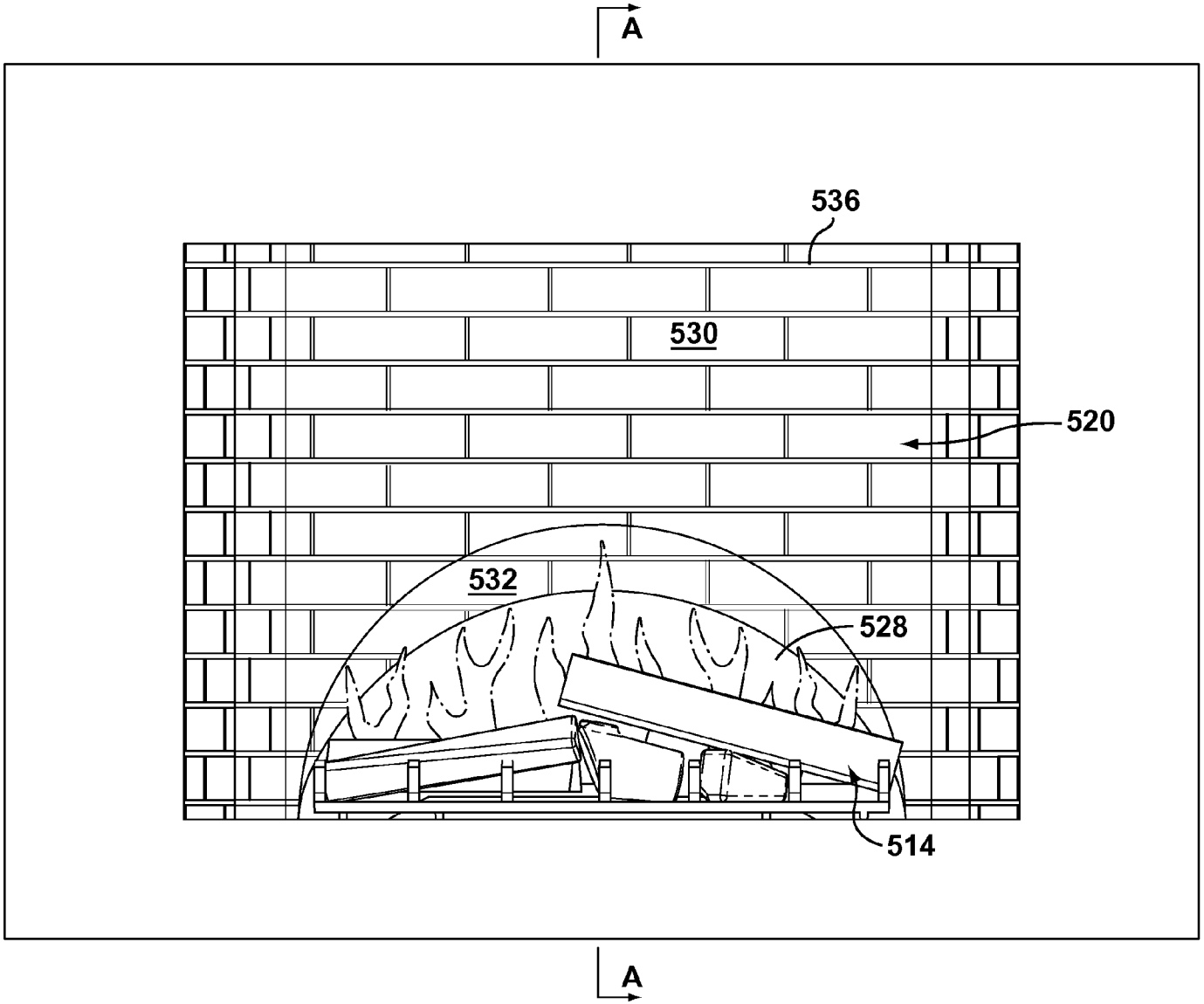
FIG. 18 is a front view of the flame simulating assembly of FIG. 15.
Figure 19:
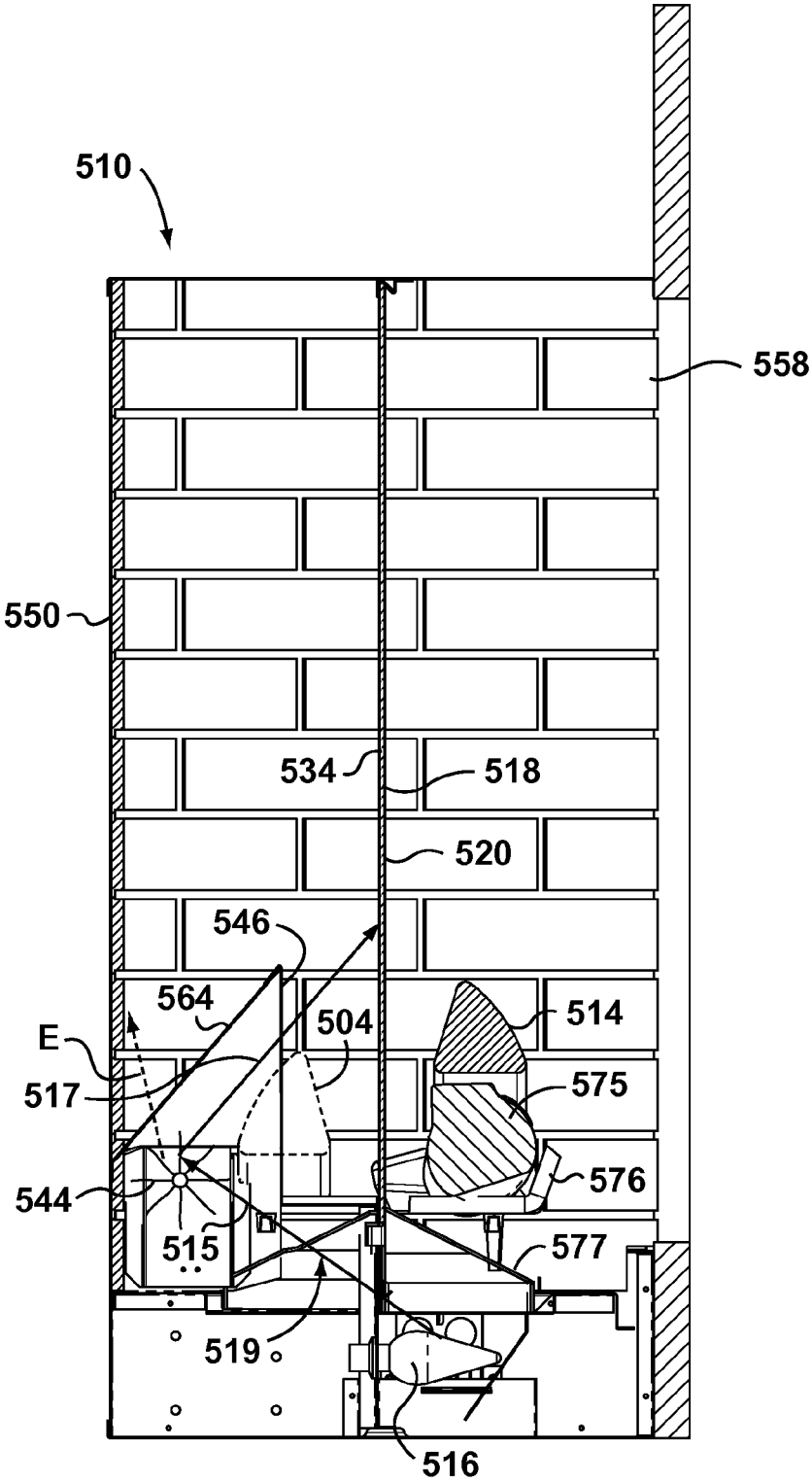
FIG. 19 is a cross-section of the flame simulating assembly of FIG. 18, taken along line A-A in FIG. 18.
Figure 19:
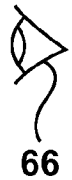

Another alternative embodiment of a flame simulating assembly 510 is disclosed in FIGS. 15-19. As can be seen in FIG. 15, the flame simulating assembly 510 is for providing one or more images of flames 11. The flame simulating assembly 510 includes one or more light sources 516 for producing the image of flames 11 and a screen 518 including a front surface 520 and positioned in a path of light 519 from the light source 516 (FIG. 19). The screen 518 is adapted for transmission of the image of flames 11 through the screen 518, so that the image of moving flames is viewable on at least part of the front surface, as will be described. The flame simulating assembly 510 also includes one or more simulated interior fireplace walls 526 positioned behind the screen 518. Preferably, the screen is adapted to permit observation of at least part of the simulated interior fireplace wall. In one embodiment, the front surface 520 of the screen 518 preferably includes one or more observation regions 530 adapted to permit observation of at least part of the simulated interior fireplace wall 526 (FIGS. 15-18). Preferably, the flame simulating assembly 510 also includes a first simulated fuel bed 514 positioned in front of the screen 518. It is also preferred that the flame simulating assembly 510 includes a second simulated fuel bed 504 positioned behind the screen 518 and at least partially viewable through the screen 518, as will be described.

Preferably, the front surface 520 of the screen 518 includes a viewing region 528 through which the image of flames 11 is transmittable. It is also preferred that the viewing region 528 is partially reflective, for providing a virtual image 533 of at least part of the first simulated fuel bed 514 (FIG. 15). As can be seen in FIG. 15, at least a preselected portion 506 (FIG. 17) of the second simulated fuel bed 504 is positioned relative to the virtual image 533 so that the second simulated fuel bed 504 appears to be part of the first simulated fuel bed 514. Preferably, the second simulated fuel bed 504 includes two or more portions 506 (e.g., one portion 506 at each side of the screen 518, and behind the screen), however, those skilled in the art would appreciate that the second simulated fuel bed 504 may have any suitable number of portions 506.

Figure 24:
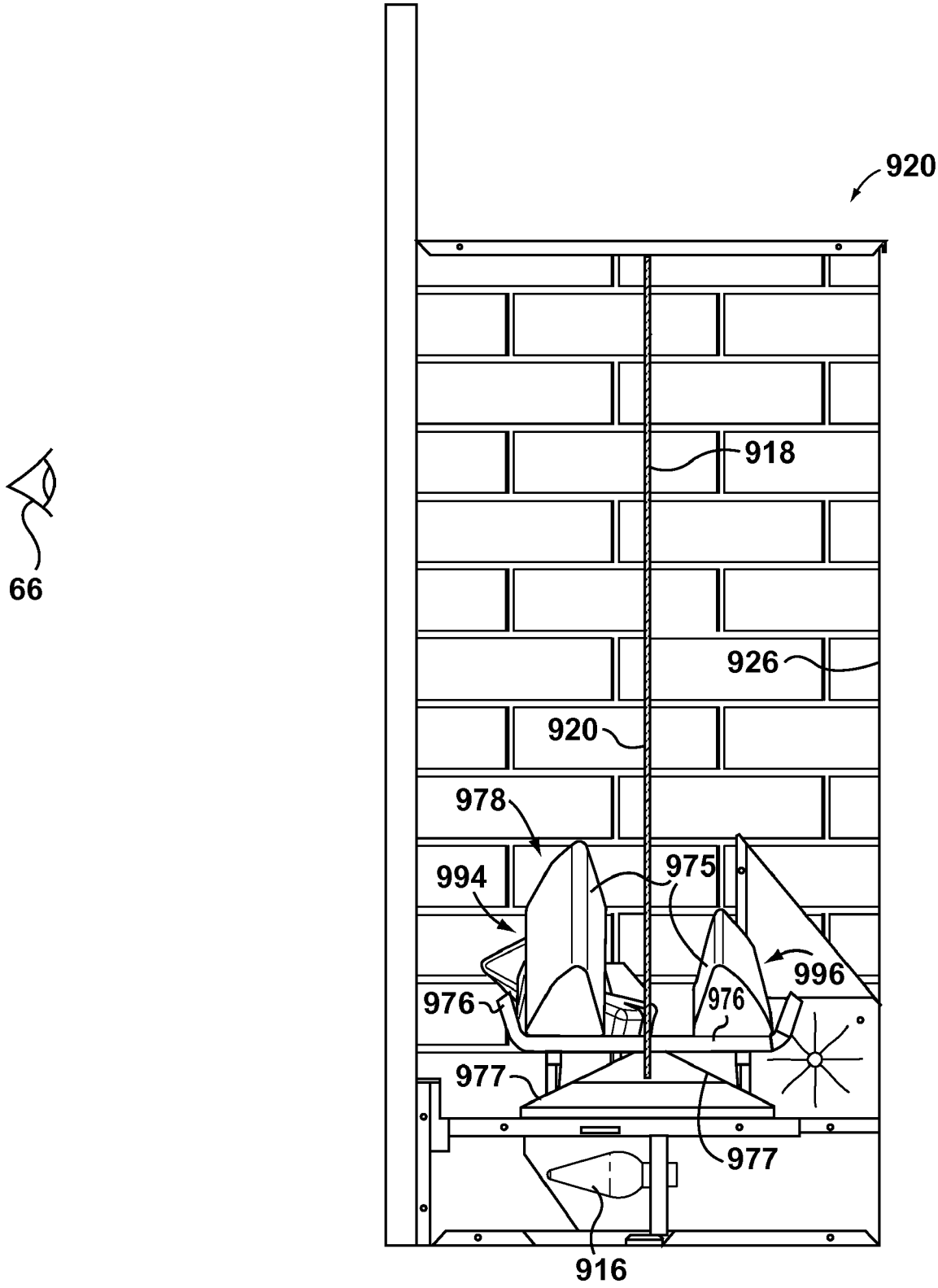
FIG. 24 is a cross-section of another alternative embodiment of the flame simulating assembly of the invention.

As can be seen in FIGS. 15-17 and 19, in one embodiment, the first simulated fuel bed 514 preferably includes simulated logs 575, a simulated grate 576, and a simulated ember bed 577 positioned substantially below the simulated grate. Also, the second simulated ember bed 506 preferably includes simulated logs 575, a simulated grate 576, and a simulated ember bed 577. As noted above, the simulated fuel beds are shown in FIGS. 15-17 and 19 as separate structures, and the second simulated fuel bed is formed and positioned so that it (i.e., its respective elements) are located relative to the first simulated fuel bed (i.e., relative to the respective elements of the first simulated fuel bed) so as to provide the observer with the illusion that the first and second simulated fuel beds are one fuel bed, as would be the case in a real fire. As shown in FIG. 24, the first and second simulated fuel beds (or one or more elements thereof, as the case may be) may be provided as one physical structure. For example, one or more simulated logs 575 may extend through the screen, if desired. In addition, or alternatively, the simulated grate may be a single unit, extending on both sides (i.e., in front and behind) of the screen. Also, or alternatively, the simulated ember bed may extend from the front of the screen to behind the screen, e.g., extending underneath the screen. Alternatively, and as shown in FIGS. 15-17 and 19, the simulated fuel beds in front of and behind the screen may be in separate physical structures positioned relative to each other as required.

It is also preferred that the front surface 520 of the screen 518 additionally includes a transition region 532 disposed between the viewing region 528 and the observation region 530. Preferably, the image of flames 11 is at least partially transmittable through the transition region 532, and the simulated interior fireplace wall 526 and the second simulated fuel bed 504 are also at least partially observable through the transition region 532. The screen 518 includes a back surface 534 located behind and opposite to the front surface 520. The portion of the back surface 534 which is opposite to the viewing region 528 preferably is adapted to diffuse light transmitted therethrough. In addition, in the portion of the back surface 534 which is located opposite to the transition region 532, the back surface 534 preferably diffuses light transmitted therethrough to a limited extent only. It is also preferred that the portion of the back surface 534 which is opposite to the observation region 530 is substantially transparent.

Although the viewing region 528, the transition region 532, and the observation region 530 are shown in FIGS. 15-18 as having distinct boundaries separating them from each other, it will be understood that the changes from one such region to another preferably are gradual, and not noticeable.

As can be seen in FIGS. 15, 17, and 18, the simulated interior fireplace wall 526 preferably includes a pattern 536. In one embodiment, the pattern simulates firebrick. Preferably, the flame simulating assembly 510 includes a 548 and the simulated interior fireplace wall 526 is mounted on a back wall 550 of the housing 548. It is also preferred that the back wall 550 includes real firebricks, to enhance the simulation effect provided thereby.

Figure 16:
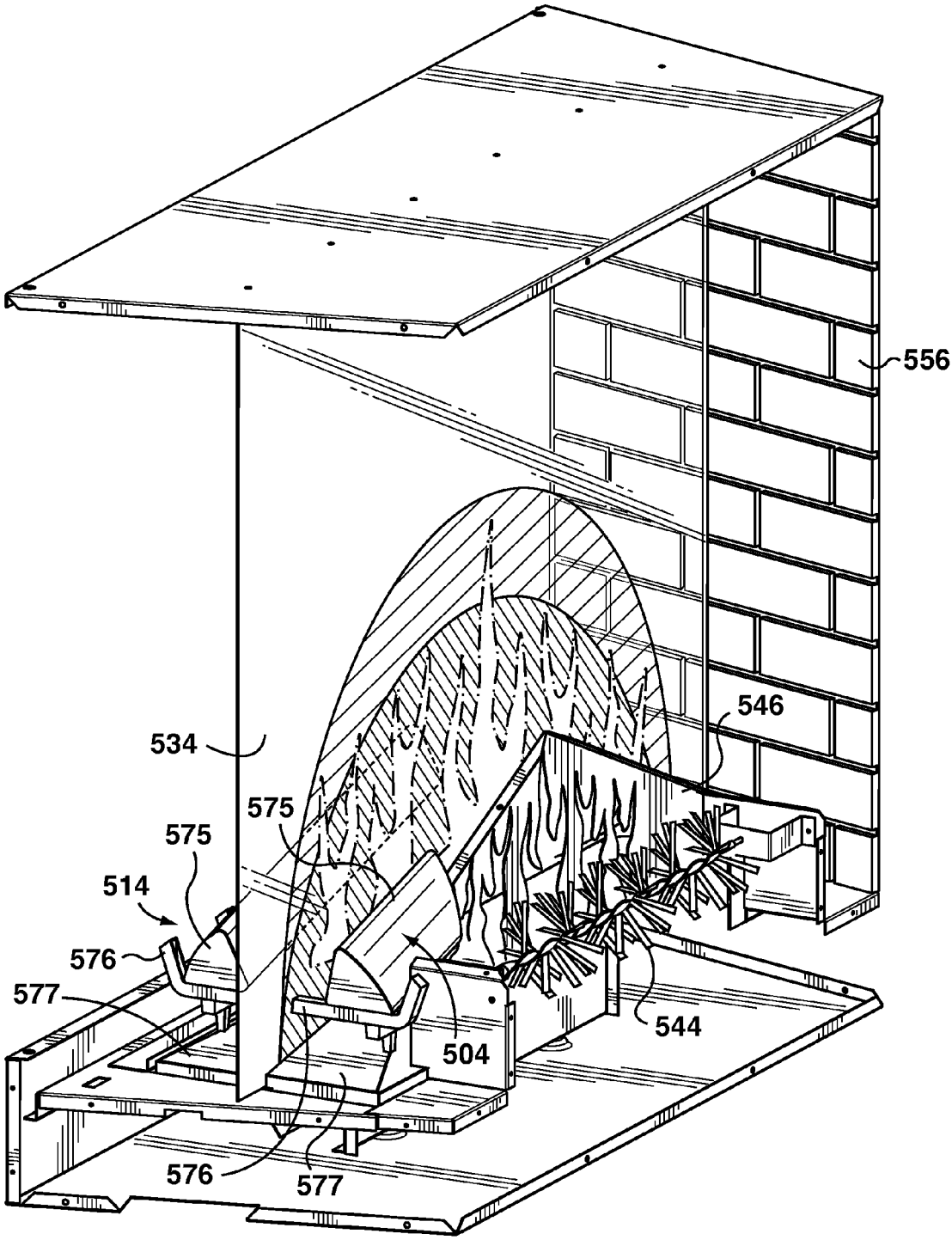
FIG. 16 is another isometric view, partially cut away, of the flame simulating assembly of FIG. 15.

It will be understood that, in FIGS. 16 and 17, certain parts of the housing 548 have been excluded for clarity of illustration.

As can be seen in FIGS. 15-19, the housing 548 also includes two or more simulated interior fireplace side walls 556, 558 which each extend forwardly from the back wall 550. Preferably, the side walls 556, 558 extend from the back wall 550 beyond the front surface 520 of the screen 518. It is also preferred that the side walls 556, 558 include patterns 542 which are consistent with the pattern 536 which is in or on the simulated interior fireplace wall 526 (i.e., the back wall 550).

For example, in one embodiment where the pattern 536 simulates firebrick (or where actual firebrick is in the simulated interior fireplace wall 526), the patterns 542 also simulate firebrick. The patterns 542 preferably are configured to mate with the firebrick pattern 536 in or on the simulated interior fireplace wall 526.

In order to provide an improved simulation effect, it is also preferred that the flame simulating assembly 510 includes a flame effect element 546 which configures light from the light source 516 to form the images of flames 11. The flame effect element 546 is positioned in the path of light 519 between the light source 516 and the screen 518 (FIG. 19). In addition, the flame simulating assembly 510 also preferably includes a flicker element 544 to cause light from the light source to fluctuate to form the images of flames 11. The flicker element 544 is also positioned in the path of light 519 between the light source 516 and the screen 518. The path of light 519 is schematically illustrated by arrows 515, 517 (FIG. 19).

In use, light from the light source 516 is reflected by the flicker element 544 as the flicker element 544 rotates, causing the reflected light to fluctuate, so that the reflected light fluctuates similarly to fluctuating light provided by a fire. The fluctuating light from the light source 516 is configured by the flame effect element 546 so that the fluctuating light forms the images of flames 11 observable in the viewing region 528 and, to an extent, in the transition region 532. An observer therefore can observe the images of flames 11 and, simultaneously, the patterns 536, 542 on the simulated interior fireplace wall 526 and the side walls 556, 558, thereby enhancing the simulation effect. (The eye 66 of the observer is shown in FIG. 19.) In addition, the observer also simultaneously can observe the portions 506 of the second simulated fuel bed 504. As indicated above, such portions 506 preferably are positioned relative to the virtual image 533 of the first simulated fuel bed 514 so that the second simulated fuel bed 504 appears to be a part of the first simulated fuel bed 514, thereby further enhancing the simulation effect.

As can be seen in FIG. 19, the flame simulating assembly preferably includes a light control member 564. The purpose of the light control member 564 is to control light which, in the absence of the member 564, would illuminate the back wall 550 and the side walls 556, 558 (or be directed to the screen 518) to distract the observer, thereby undermining the overall simulation effect provided by the flame simulating assembly 510. In one embodiment, the member 564 is a piece of sheet metal or other similar material intended to obstruct the light, to prevent its escape to produce distracting lighting effects behind the screen.

In an alternative embodiment, the member 564 includes a light randomizer or scatterer or diffuser, i.e., so as to diffuse light and not transmit an image. In this embodiment, light from the light source 516 is directed to the scatterer 564 and scattered or diffused to provide an unfocused light propagated generally rearwardly, and somewhat upwardly, as schematically illustrated by arrow "E" in FIG. 19. Accordingly, in this embodiment, light directed through the randomizer 564 resembles light from a real fire directed onto a back wall and side walls in a fireplace, thereby enhancing the simulation effect.

Figure 20:
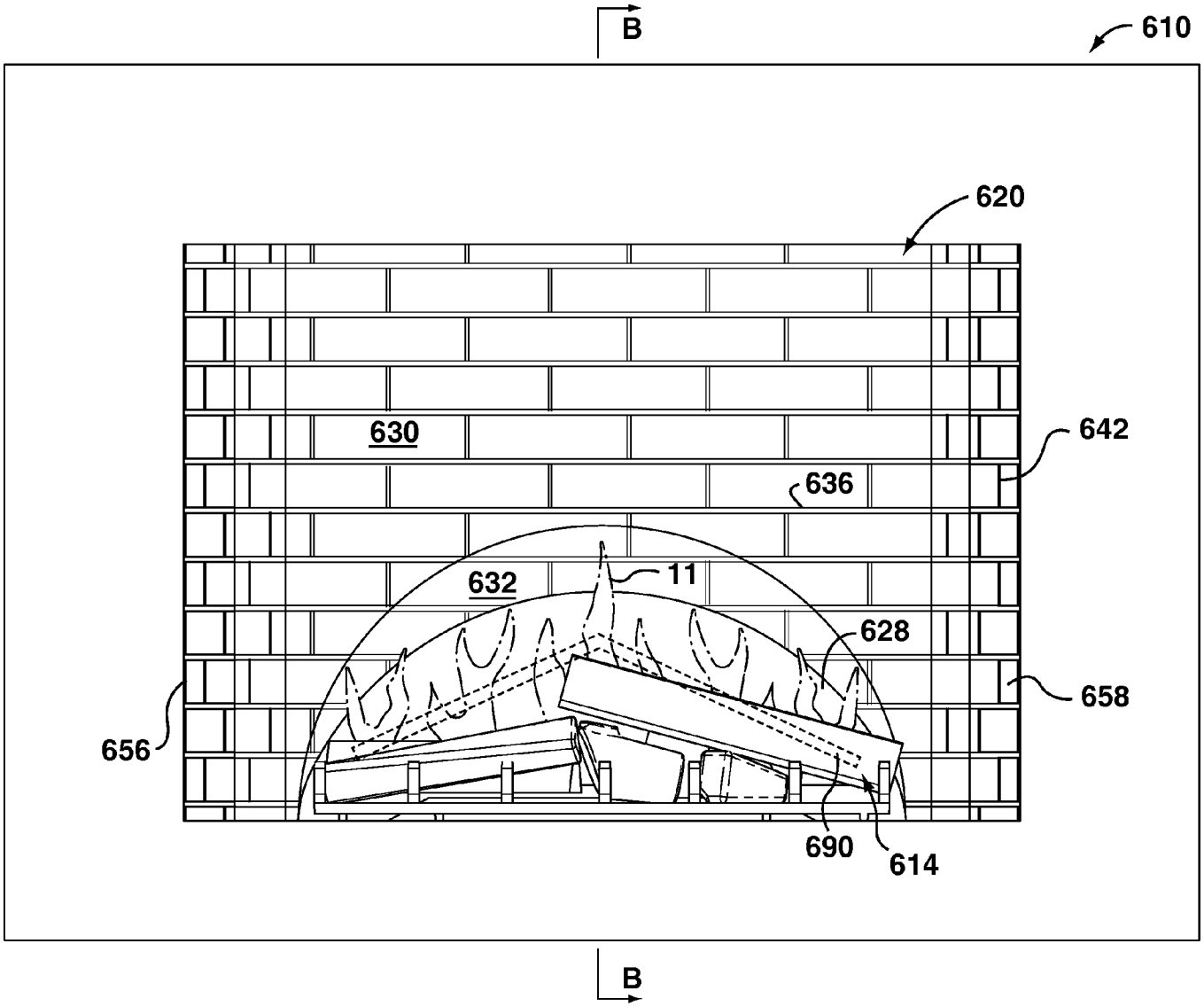
FIG. 20 is a front view of another alternative embodiment of the flame simulating assembly of the invention.
Figure 21:
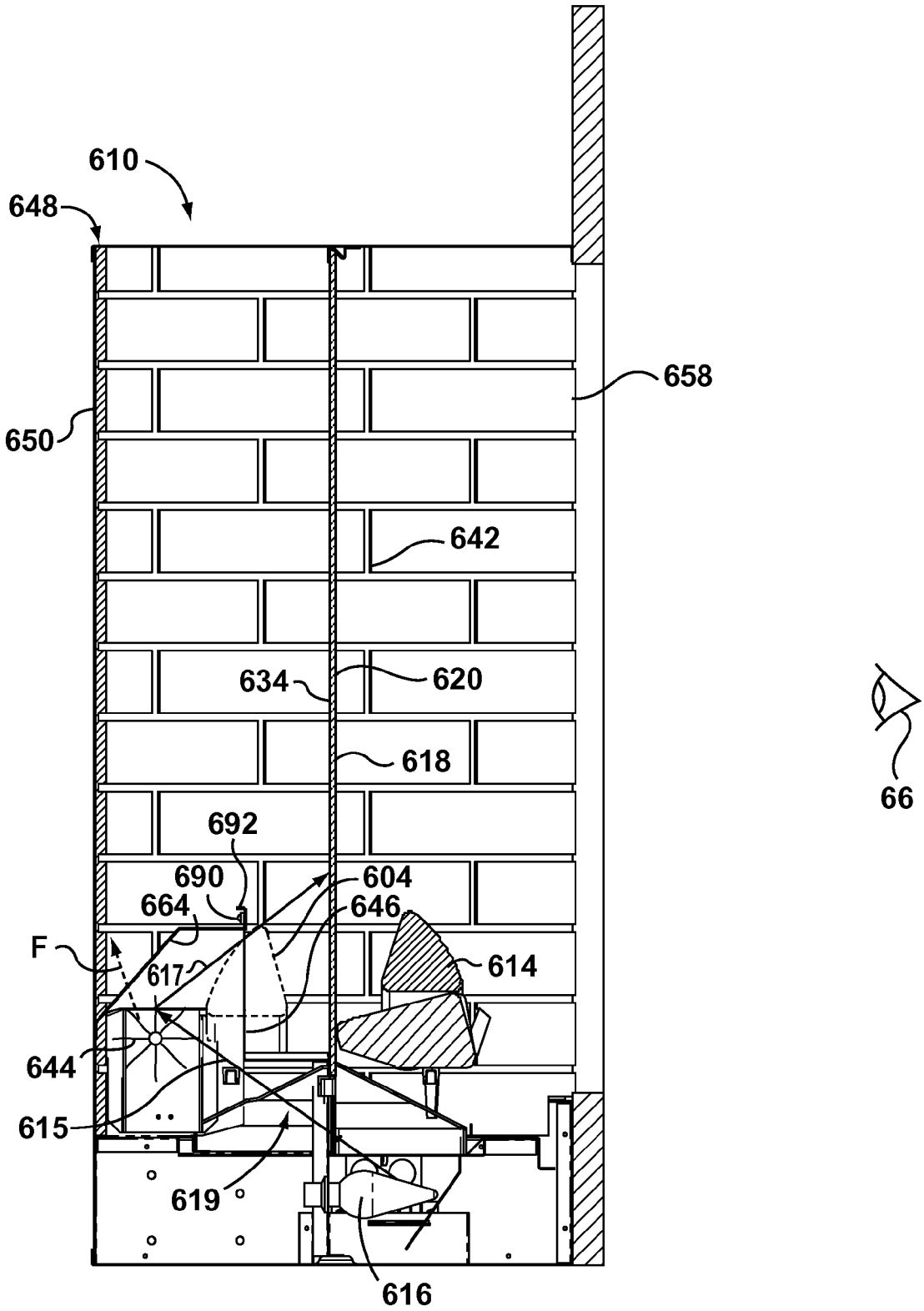
FIG. 21 is a cross-section of the flame simulating assembly of FIG. 20.

Another alternative embodiment of a flame simulating assembly 610 is shown in FIGS. 20 and 21. As can be seen in FIG. 21, the flame simulating assembly includes one or more light sources 616 for providing images of flames 11. In addition, the flame simulating assembly 610 includes a screen 618 with a front surface 620 positioned in a path of light 619 from the light source 616 (FIG. 21). (The path of light 619 is schematically illustrated by arrows 615, 617 in FIG. 21.) As in other embodiments of the flame simulating assembly described herein, the screen 618 is adapted for transmission of the images of moving flames 11 through the front surface 620. Preferably, the flame simulating assembly 610 also includes a simulated interior fireplace wall 626 positioned behind the screen 618. It is also preferred that the front surface 620 of the screen 618 includes one or more observation regions 630 which permit observation of at least part of the simulated interior fireplace wall 626. The flame simulating assembly 610 preferably includes one or more background light sources 690 (FIG. 21) for providing light to at least partially illuminate the simulated interior fireplace wall 626.

Preferably, the flame simulating assembly 610 includes a housing 648 with a back wall 650. The simulated interior fireplace wall 626 preferably is mounted on the back wall 650. Similarly to the screens described above, the front surface 620 of the screen 618 includes a viewing region 628, and observation region 630, and a transition region 632 positioned between the viewing region 628 and the observation region 630. Although the viewing region 628, the transition region 632, and the observation region 630 are shown in FIG. 20 as having distinct boundaries separating them from each other, it will be understood that the changes from one such region to another preferably are gradual, and are not noticeable.

In one embodiment, the light provided by the background light source 690 flickers so that such light simulates flickering (or fluctuating) light provided by a fire. Such light is intended to simulate light from a fire which would be directed towards the back wall and the side walls. Accordingly, the flickering or fluctuating thereof should flicker in a way which is generally consistent with the flickering light from the light source 616 which provides the flame effect.

Different ways to cause light from the background light source 690 to flicker or fluctuate would be known to those skilled in the art. For example, in order to cause light from the background light source 690 to flicker, the invention disclosed in U.S. Pat. No. 6,385,881 could be used. U.S. Pat. No. 6,385,881 is hereby incorporated herein by reference. The '881 patent discloses a device including a photosensor, a control circuit, and display lighting to produce a flickering effect that is substantially synchronized with changes in light intensity occurring within the simulated fireplace.

Alternatively, the background light source 690 could be caused to flicker by means of a controlling means, as disclosed at paragraphs 0076-0082 in co-pending U.S. patent application Ser. No. 11/252,596, filed on Oct. 19, 2005. The entire specification of U.S. patent application Ser. No. 11/252,596 is hereby incorporated herein by reference.

It is also preferred that the flame simulating assembly 610 includes a background light shield 692 for obstructing light from the background light source 690 (FIG. 21). The background light source 690 preferably is positioned behind the screen 618 to illuminate the back wall and the side walls, as will be described. The shield 692 is used to enhance the simulation effect provided by the flame simulating assembly 610. The shield 692 limits the extent of illumination provided by the background light source 690 so that such illumination is limited to affect only a preselected part of the back wall and/or the side walls, to simulate the illumination of back and/or side walls by a fire. The shield 692 is advantageous because, in the absence thereof, light from the background light source 690 would be allowed to be directed upwardly and/or forwardly (i.e., towards the screen 618), thereby providing a distraction to the observer inconsistent with the flame simulation effect sought to be achieved with the flame simulating assembly 610. (The eye 66 of the observer is shown in FIG. 21.)

In one embodiment, the housing 648 includes two or more simulated interior fireplace side walls 656, 658. Each of the simulated interior fireplace side walls 656, 658 extends forwardly from the back wall 650. It is also preferred that the background light source 690 at least partially illuminates the simulated interior fireplace side walls 656, 658, as well as illuminating (at least in part) the simulated interior fireplace wall 626.

In use, light from the light source 616 is reflected by a rotating flicker element 644, which causes the light from the light source 616 to fluctuate. The fluctuating light is configured by a flame effect element 646 to provide images of flames 11 which are transmitted through the screen 618. The images of flames 11 are observable in the viewing region 628 and in the transition region 632, to an extent.

As can be seen in FIG. 21, the flame simulating assembly preferably includes a light control member 664. The purpose of the light control member 664 is to control light from the light source 616 which, in the absence of the member 664, would illuminate the back wall 650 and the side walls 656, 658 (and/or be directed to the screen 618) and thus distract the observer, thereby undermining the overall simulation effect provided by the flame simulating assembly 610. In one embodiment, the member 664 is a piece of sheet metal or other similar material intended to obstruct the light, to prevent it from producing distracting lighting effects behind the screen or on the screen, as the case may be.

In an alternative embodiment, the member 664 includes a light randomizer (or scatterer or diffuser), i.e., so as to diffuse light and not transmit an image. In this embodiment, light from the light source 616 is directed to the scatterer 664 and scattered or diffused to provide an unfocused light propagated generally rearwardly, and somewhat upwardly, as schematically illustrated by arrow "F" in FIG. 21. Accordingly, in this embodiment, light directed through the member 664 resembles light from a real fire, thereby enhancing the simulation effect.

The simulated interior fireplace wall 626 and the simulated interior fireplace side walls 656, 658 are illuminated by the background light source 690, which provides a flickering (or fluctuating) light similar to the light provided by a fire. The illumination of the simulated interior fireplace wall 626 and the simulated interior fireplace side walls 656, 658 enhances the simulation effect, as such illumination is observable through the observation region 630 and, to an extent, also through the transition region 632. Accordingly, the observer can view the illuminated simulated interior fireplace wall 626 and the simulated interior fireplace side walls 656, 658 simultaneously when viewing the image of flames 11 in the viewing region 628 and, to an extent, in the transition region 632. The overall effect achieved is an effective simulation of a fire in a fireplace.

In one embodiment, the simulated interior fireplace wall 626 preferably includes a pattern 636, and the simulated interior fireplace side walls 656, 658 also include one or more patterns 642 in or on the side walls 656, 658. As described above, it is preferred that the patterns 636, 642 resemble firebrick, and it is also preferred that the patterns 636, 642 mate (i.e., are substantially aligned) with each other, to provide an enhanced simulation effect.

As shown in FIGS. 20 and 21, the background light source 690 preferably is mounted on the flame effect element 646. Because the background light source 690 preferably is positioned at about the middle of the simulated fire as depicted, it is advantageous to position the background light source 690 on the flame effect element 646. The positioning of the flame effect element 646 is convenient for this purpose also because the flame effect element 646 preferably is spaced apart from the back surface 634 of the screen 618 by a relatively small distance, thus facilitating the positioning of the background light source 690 relatively close to the screen 618 and behind the screen 618 when the background light source 690 is mounted on the flame effect element 646.

Those skilled in the art will appreciate that the background light source 690 may be positioned appropriately relative to the simulated interior fireplace wall 626 and/or the side walls 656, 658 by a wide variety of means.

Preferably, the background light source 690 includes a number of light-emitting diodes (LEDs) which substantially illuminate at least parts of the simulated interior fireplace wall 626 and the side walls 656, 658. In particular, it is preferred that the background light source 690 illuminates the simulated interior fireplace wall 626 across substantially the width thereof. The background light source 690 preferably provides light which is amber in color. Alternatively, mini-incandescent light bulbs are used instead of LEDs.

Figure 22:
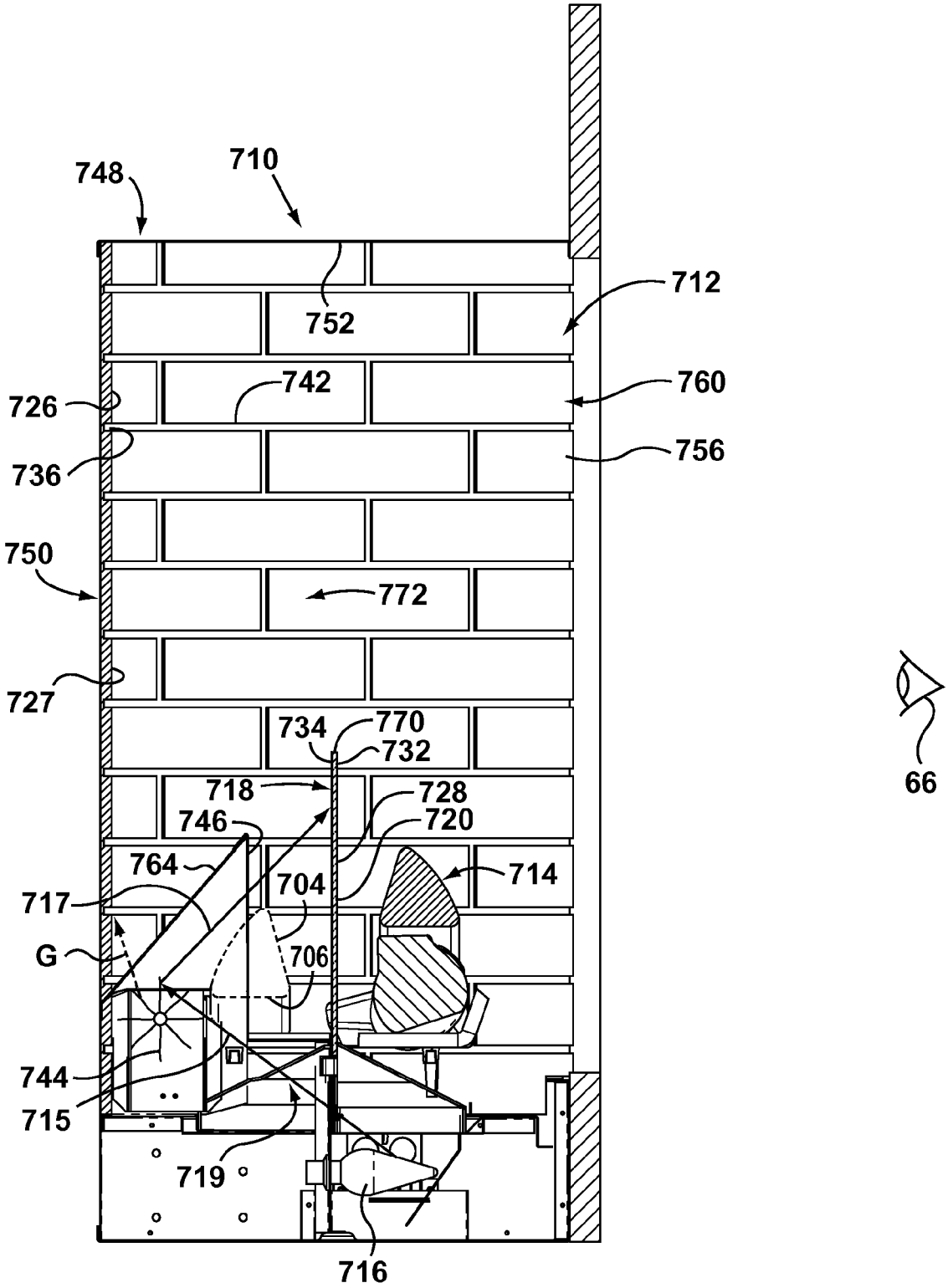
FIG. 22 is a cross-section of another alternative embodiment of the flame simulating assembly of the invention.

Another alternative embodiment of a flame simulating assembly 710 is disclosed in FIG. 22. The flame simulating assembly 710 is similar to the flame simulating assembly 510, except that a screen 718 in the flame simulating assembly 710 differs substantially from the corresponding screen 518 which is included in the flame simulating assembly 510. As shown in FIG. 22, the flame simulating assembly 710 includes a housing 748 having a back wall 750 with an exposed surface 727, and the housing 748 defines a cavity 760 which is open at a front end 712 of the housing 748. The flame simulating assembly 710 preferably includes one or more light sources 716 for producing images of flames 11. The flame simulating assembly 710 also includes the screen 718 disposed in the cavity 760 in front of the back wall 750 and positioned in a path of light 719 from the light source 716, as will be described. The screen 718 includes a front surface 720 adapted for transmitting the images of flames 11 therethrough, as described above in connection with the screen 518. It is also preferred that the flame simulating assembly includes a first simulated fuel bed 714 positioned in front of the screen 718 and adjacent to the front surface 720. In addition, the screen 718 preferably includes a top edge 770 which is spaced apart from a roof portion 752 to form an upper opening 772. As can be seen in FIG. 22, the roof portion 752 defines an upper side of the cavity 760. At least part of the exposed surface 727 of the back wall 750 is observable through the upper opening 772. Finally, the flame simulating assembly 710 additionally includes a second simulated fuel bed 704 positioned behind the screen 718 and at least partially viewable through the screen 718.

As can be seen in FIG. 22, the flame simulating assembly 710 also includes a flicker element 744 positioned in the path of light 719 (schematically represented by arrows 715, 717) and a flame effect element 746, also positioned in the path of light 719. The flame effect element 746 is for configuring light from the light source 716 into one or more images of flames 11 which are transmitted through the screen 718. The flicker element 744 is for causing light from the light source to flicker or fluctuate (i.e., similarly to flickering light produced by a fire), thereby enhancing the overall simulation effect.

The front surface 720 of the screen 718 preferably includes a viewing region 728, and a transition region 732 disposed at least partially between the viewing region 728 and the top edge 770. In the preferred embodiment, the viewing region 728 is partially reflective, and the images of flames 11 are also transmittable through the viewing region 728. The screen 718 could be suitably tinted glass or plastic (or other suitable material) through which the images of flames are transmittable. Preferably, the transition region 732 extends from the viewing region 728 to the top edge 770. The transition region 732 is preferably less silvered then the viewing region 728 (and therefore the transition region 732 is also partly reflective, but less so generally than the viewing region 728), so that the back wall 750 is at least partially viewable through the transition region 732. The images of flames 11 are also at least partially observable through the transition region 732. A back surface 734 of the screen 718 diffuses light from the light source 716, to enhance the overall simulation effect. Preferably, the viewing region 728 is at least partially translucent. The transition region 732 also could be suitably tinted, to enhance the overall simulation effect.

In an alternative embodiment, the front surface of the screen 718 may include one or more observation regions, generally disposed between the transition region 732 and the top edge 770.

It will be understood that the top edge 770 may be curved, or substantially horizontal. If curved, for example, the top edge 770 may define a screen which is (for example) generally semi-circular, to provide a flat surface which is sufficiently large to accommodate the image of flames 11 which is commensurate with the simulated fuel bed 714.

Preferably, the housing 748 additionally includes two or more simulated interior fireplace side walls which each extend forwardly from the back wall 750. (It will be understood that only one side wall 756 is shown in FIG. 22 for clarity. The opposing side wall is the same as side wall 756 in all material aspects.) In one embodiment, the back wall 750 includes real firebricks. In other embodiments, the back wall 750 consists of suitable materials which are formed into a pattern 736 to be included in the simulated interior fireplace wall 726, to simulate firebrick. It is also preferred that the side walls extend from the back wall 750 beyond the front surface 720 of the screen 718. Preferably, the side walls include patterns 742 which are consistent with the pattern 736 which is in or on the simulated interior fireplace wall 726 (i.e., the back wall 750). Preferably, the patterns 742 on the side walls are substantially aligned with the pattern 736 on the back wall 750. Similarly, if the back wall 750 includes firebrick, then the patterns 742 preferably are substantially aligned with the firebrick (at least in part) forming the back wall 750.

As can also be seen in FIG. 22, substantially unobstructed observation is permitted through the upper opening 772, so that part of the back wall 750 (i.e., the exposed surface 727 of the back wall 750) is observable. Also, parts of the side walls are observable through the opening 772. This is substantially similar to the substantially unobstructed observation of a firebox of a fireplace (i.e., one in which wood or coal may be burned) which may be enjoyed by an observer of the fireplace, the upper opening 772 therefore tends to enhance the overall simulation effect. (The eye 66 of the observer is shown in FIG. 22.) A light control member 764 may also be included in the flame simulating assembly 710. The light control member 764 is for obstructing light from the light source 716 which may be directed above the top edge 770 of the screen 718, or be viewable through the opening 772, and the member 764 also is useful for concealing certain components. The member 764 preferably is positioned behind the screen 718 and beside or below the transition region 732. It is possible that the observer could be positioned so as to view some of the internal components (such as the flicker element 744, or the flame effect element 746) directly, or light from the light source 716 may be directed above the top edge 770 on occasion or viewable through the opening 772, to distract the viewer. In either or both of these circumstances, it may be advantageous, therefore, to include the light control member 764 in the flame simulating assembly 710.

As can be seen in FIG. 22, the flame simulating assembly preferably includes a light control member 764. The purpose of the light control member 764 is to control light from the light source 716 which, in the absence of the member 764, would illuminate the back wall 750 and the side walls (and/or be directed to the screen 718) and thus distract the observer, thereby undermining the overall simulation effect provided by the flame simulating assembly 710. In one embodiment, the member 764 is a piece of sheet metal or other similar material intended to obstruct the light, to prevent it from providing distracting lighting effects behind the screen or on the screen, as the case may be.

In an alternative embodiment, the member 764 includes a light randomizer (or scatterer or diffuser), i.e., so as to diffuse light and not transmit an image. In this embodiment, light from the light source 716 is directed to the scatterer 764 and scattered or diffused to provide an unfocused light propagated generally rearwardly, and somewhat upwardly, as schematically illustrated by arrow "G" in FIG. 22. Accordingly, in this embodiment, light directed through the member 764 resembles light from a real fire, thereby enhancing the simulation effect.

As described above, it is preferred that the second simulated fuel bed 704 includes more than one separate log portion 706, and the separate log portions are preferably located on either side of the screen, and behind the screen. It will be understood that only one log portion of the second simulated fuel bed 704 is shown (i.e., in dashed outline) in FIG. 22 for clarity.

In use, light from the light source 716 is reflected by the flicker element 744 as the flicker element 744 rotates, causing the reflected light to fluctuate similarly to fluctuating light provided by a fire. Preferably, the fluctuating (or flickering) light from the light source 716 is configured by the flame effect element 746 so that the fluctuating light forms the images of flames 11 observable in the viewing region 728 and, to an extent, in the transition region 732.

An observer therefore observes the images of flames 11 and, simultaneously, the patterns 736, 742 on the simulated interior fireplace wall 726 and the side walls, thereby enhancing the simulation effect. In addition, the observer also simultaneously observes portions 706 of the second simulated fuel bed 704. The portions 706 preferably are positioned relative to the virtual image (not shown in FIG. 22) of the first simulated fuel bed 714 so that the second simulated fuel bed 704 appears to be part of the first simulated fuel bed 714, thereby enhancing the overall simulation effect provided to the observer.

Where the back wall 750 includes real firebricks, the overall simulation effect is enhanced. In this embodiment, the observer simultaneously observes the firebrick in the back wall 750 and the patterns 742 on the side walls, which together provide a realistic simulation of a firebox of a real fireplace. The observer also simultaneously observes the images of flames 11 appearing substantially among (or between) the first simulated fuel bed 714 and the second simulated fuel bed 704.

Figure 23:
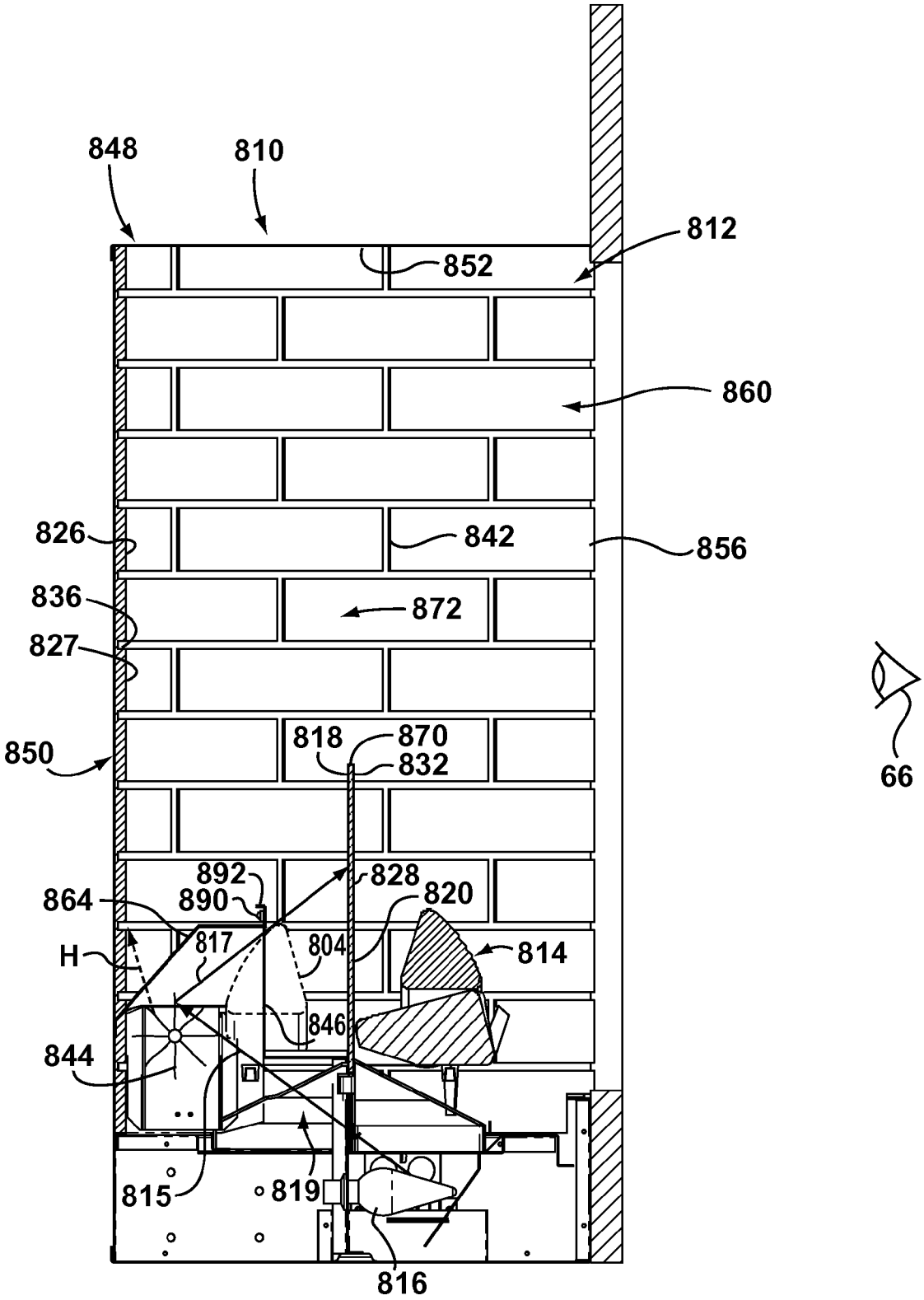
FIG. 23 is a cross-section of another alternative embodiment of the flame simulating assembly of the invention.

Another alternative embodiment of a flame simulating assembly 810 is shown in FIG. 23. As can be seen in FIG. 23, the flame simulating assembly 810 includes one or more light sources 816 for providing images of flames 11. In addition, the flame simulating assembly 810 includes a screen 818 with a front surface 820, positioned in a path of light 819 from the light source 816. (The path of light 819 is schematically illustrated by arrows 815, 817 in FIG. 23.) As in other embodiments of the flame simulating assembly of the invention described herein, the screen 818 is adapted to transmit the images of flames 11 through the front surface 820. Preferably, the flame simulating assembly 810 also includes a simulated interior fireplace wall 826 positioned behind the screen 818.

As shown in FIG. 23, the flame simulating assembly 810 includes a housing 848 having a back wall 850 with an exposed surface 827, and the housing 848 defines a cavity 860 which is open at a front end 812 of the housing 848. The screen 818 is disposed in the cavity 860 in front of the back wall 850. It is also preferred that the flame simulating assembly 810 includes a first simulated fuel bed 814 positioned in front of the screen 818 and adjacent to the front surface 820. In addition, the screen 818 preferably includes a top edge 870 which is spaced apart from a roof portion 852 of the housing 848 to form an upper opening 872. As can be seen in FIG. 23, the roof portion 852 defines an upper side of the cavity 860. At least part of the exposed surface 827 of the back wall 850 is observable through the upper opening 872. In addition, the flame simulating assembly 810 includes a second simulated fuel bed 804 positioned behind the screen 818 and at least partially viewable through the screen 818, as will be described.

As can be seen in FIG. 23, the flame simulating assembly 810 also includes a flicker element 844 positioned in the path of light 819 and a flame effect element 846, also positioned in the path of light 819. The flame effect element 846 is for configuring light from the light source 816 into one or more images of flames 11 which are transmitted through the screen 818. The flicker element 844 is for causing light from the light source to flicker or fluctuate (i.e., similarly to flickering light produced by a fire), thereby enhancing the overall simulation effect.

The front surface 820 of the screen 818 preferably includes a viewing region 828, and a transition region 832 disposed at least partially between the viewing region 828 and the top edge 870. In the preferred embodiment, the viewing region 828 is partially reflective, and the images of moving flames 11 are also transmittable through the viewing region 828. The screen 818 could be suitably tinted glass or plastic (or other suitable material) through which the images of flames 11 are transmittable. Preferably, the transition region 832 extends from the viewing region 828 to the top edge 870. The transition region 832 is preferably less silvered then the viewing region 828 (and therefore the transition region 832 is also partly reflective, but less so generally than the viewing region 828), so that the back wall 850 is at least partially viewable through the transition region 832. The images of flames 11 are also at least partially observable through the transition region 832. A back surface 834 of the screen 818 diffuses light from the light source 816, to enhance the overall simulation effect. Preferably, the viewing region 828 is at least partially translucent. The transition region 832 also could be suitably tinted, to enhance the overall simulation effect. In an alternative embodiment, the front surface 820 may include one or more observation regions, generally disposed between the transition region 832 and the top edge 870.

It will be understood that the top edge 870 may be curved, or substantially horizontal. If curved, for example, the top edge 870 may define a screen which is (for example) generally semi-circular, to provide a flat surface which is sufficiently large to accommodate the image of flames 11 which is commensurate with the simulated fuel bed 814.

Preferably, the housing 848 additionally includes two or more simulated interior fireplace side walls which each extend forwardly from the back wall 850. (It will be understood that only one side wall 856 is shown in FIG. 23 for clarity. The opposing side wall is the same as side wall 856 in all material aspects.) In one embodiment, the back wall 850 includes real firebricks. In other embodiments, the back wall 850 consists of suitable materials which are formed into a pattern 836 to be included in the simulated interior fireplace wall 826, to simulate firebrick. It is also preferred that the side walls extend from the back wall 850 beyond the front surface 820 of the screen 818. Preferably, the side walls include patterns 842 which are consistent with the pattern 836 which is in or on the simulated interior fireplace wall 826 (i.e., the back wall 850).

In one embodiment, the back wall 850 includes real firebricks, to provide an enhanced simulation. In this embodiment, the patterns 842 on the side walls are substantially aligned with the firebricks in the back wall, to simulate an interior of a firebox in a real fireplace.

As can also be seen in FIG. 23, substantially unobstructed observation is permitted through the upper opening 872, so that part of the back wall 850 (i.e., the exposed surface 827 of the back wall 850) is observable. Also, parts of the side walls are observable through the opening 872. This is substantially similar to the substantially unobstructed observation of a firebox in a fireplace (i.e., one in which wood or coal may be burned) which may be enjoyed by an observer of the fireplace, the upper opening 872 therefore tends to enhance the overall simulation effect. (The eye 66 of the observer is shown in FIG. 23.)

The flame simulating assembly 810 preferably includes one or more background light sources 890 for providing light to at least partially illuminate the simulated interior fireplace wall 826.

In one embodiment, the light provided by the background light source 890 flickers so that such light simulates flickering (or fluctuating) light provided by a fire. Such light is intended to simulate light from a fire which would be directed towards the back wall and the side walls. Accordingly, the flickering or fluctuating thereof preferably flickers in a manner which is generally consistent with the flickering light from the light source 816 which provides the flame effect.

Different ways to cause light from the background light source 890 to flicker or fluctuate would be known to those skilled in the art. For example, in order to cause light from the background light source 890 to flicker, the invention disclosed in U.S. Pat. No. 6,385,881 could be used. The '881 patent discloses a device including a photosensor, a control circuit, and display lighting to produce a flickering effect that is substantially synchronized with changes in light intensity occurring within the simulated fireplace.

Alternatively, the background light source 890 could be caused to flicker by means of a controlling means, as disclosed at paragraphs 0076-0082 in co-pending U.S. patent application Ser. No. 11/252,596, filed on Oct. 19, 2005. The entire specification of U.S. patent application Ser. No. 11/252,596 is hereby incorporated herein by reference.

It is also preferred that the flame simulating assembly 810 includes a background light shield 892 for obstructing light from the background light source 890. The background light shield 892 preferably is positioned behind the screen 818 to illuminate the back wall and the side walls, as will be described. The shield 892 is used to enhance the simulation effect provided by the flame simulating assembly 810. The shield 892 is advantageous because, in the absence thereof, light from the background light source 890 would be allowed to be directed upwardly and/or forwardly (i.e., towards the screen 818), thereby providing a distraction to the observer inconsistent with the flame simulation effect sought to be achieved with the flame simulating assembly 810.

In use, light from the light source 816 is reflected by a rotating flicker element 844, which causes such light from the light source 816 to fluctuate. The fluctuating light is configured by a flame effect element 846 to provide images of flames 11 which are transmitted through the screen 818. The images of flames 11 are observable in the viewing region 828 and in the transition region 832, to an extent.

As can be seen in FIG. 23, the flame simulating assembly preferably includes a light control member 864. The purpose of the light control member 864 is to control light which, in the absence of the member 864, would illuminate the back wall 850 and the side walls (and/or be directed to the screen 818) to distract the observer, thereby undermining the overall simulation effect provided by the flame simulating assembly 810. In one embodiment, the member 864 is a piece of sheet metal or other similar material intended to obstruct the light, to prevent it from providing distracting lighting effects behind the screen or on the screen, as the case may be.

In an alternative embodiment, the member 864 includes a light randomizer (or scatterer or diffuser), i.e., so as to diffuse light and not transmit an image. In this embodiment, light from the light source 816 is directed to the scatterer 864 and scattered or diffused to provide an unfocused light propagated generally rearwardly, and somewhat upwardly, as schematically illustrated by arrow "H" in FIG. 23. Accordingly, in this embodiment, light directed through the member 864 resembles light from a real fire, thereby enhancing the simulation effect.

The simulated interior fireplace wall 826 and the simulated interior fireplace side walls are illuminated by the background light source 890, which provides a flickering (or fluctuating) light similar to the light provided by a fire. The illumination of the simulated interior fireplace wall 826 and the simulated interior fireplace side walls enhances the simulation effect, as such illumination is observable through the opening 872 and, to an extent, also through the transition region 832. Accordingly, the observer can view the illuminated simulated interior fireplace wall 826 and the simulated interior fireplace side walls simultaneously when viewing the image of flames 11 in the viewing region 828 and, to an extent, in the transition region 832. The overall effect achieved is an effective simulation of a fire in a fireplace.

As shown in FIG. 23, the background light source 890 preferably is mounted on the flame effect element 846. Because the background light source 890 preferably is positioned at about the middle of the simulated fire as depicted, it is advantageous to position the background light source 890 on the flame effect element 846. The positioning of the flame effect element 846 is convenient for this purpose also because the flame effect element 846 preferably is spaced apart from the back surface 834 of the screen 818 by a relatively small distance, thus facilitating the positioning of the background light source 890 relatively close to the screen 818 and behind the screen 818 when the background light source 890 is mounted on the flame effect element 846.

Those skilled in the art will appreciate that the background light source 890 may be positioned appropriately relative to the simulated interior fireplace wall 826 and/or the side walls by any suitable means.

Preferably, the background light source 890 includes a number of light-emitting diodes (LEDs) which substantially illuminate at least parts of the simulated interior fireplace wall 826 and the side walls. In particular, it is preferred that the background light source 890 illuminates the simulated interior fireplace wall 826 across substantially the width thereof. The background light source 890 preferably provides light which is amber in color. Alternatively, mini-incandescent light bulbs are used instead of LEDs.

Another alternative embodiment of a flame simulating assembly 910 is shown in FIG. 24. As can be seen in FIG. 24, the flame simulating assembly 910 includes one or more light sources 916 for providing images of flames 11. The flame simulating assembly 910 also includes a screen 918 having a front surface 920 and positioned in a path of light from the light source 916. The screen 918 is adapted for transmission of the images of flames through the screen 918. The flame simulating assembly 910 additionally includes one or more simulated interior fireplace walls 926 positioned behind the screen 918. Preferably, the screen 918 is adapted to permit observation of at least part of the simulated interior fireplace wall 926. It is also preferred that the flame simulating assembly 910 includes a simulated fuel bed 978 including one or more first portions 994 positioned adjacent to the front surface 920, and one or more second portions 996 positioned behind the screen 918. The second portion 996 is at least partially viewable through the screen 918.

It is also preferred that the front surface 920 comprises an observation region 930 through which part of the interior fireplace wall is observable. Also, the front surface 920 preferably includes a viewing region 928, and the images of flames are transmittable through the viewing region.

Also, the front surface of the screen preferably includes a transition region 932 which is positioned between the viewing region and the observation region. The images of flames are at least partly transmittable through the transition region, and also the simulated interior fireplace wall and the second portion of the simulated fuel bed are partially observable through the transition region.

As can be seen in FIG. 24, the simulated fuel bed 978 preferably includes one or more simulated fuel parts 975, a simulated grate 976, and a simulated ember bed 977. Preferably, the simulated fuel parts 975 are simulated logs, which are supported by the simulated grate. It will be understood, however, that the simulated fuel bed may include components in addition to those shown, and also the simulated fuel bed may include fewer components. For example, the simulated fuel bed may consist of only the simulated logs and the simulated ember bed.

It will also be understood that the first portion and the second portion may consist of some or all of the simulated fuel parts, the simulated grate, and the simulated ember bed.

The simulated fuel bed 978 is advantageous because, due to its unitary structure, it provides an effective simulation of the fuel bed (i.e., including a grate) of a real fire.

It will be evident to those skilled in the art that the invention can take many forms, and that such forms are within the scope of the invention as claimed. Therefore, the spirit and scope of the appended claims should not be limited to the descriptions of the versions contained herein.

We claim:

1. A flame simulating assembly for providing at least one image of flames, the flame simulating assembly comprising:

at least one light source for producing said at least one image of flames;

a screen comprising a front surface and positioned in a path of light from said at least one light source, the screen being adapted for transmission of said at least one image of flames through the screen;

at least one simulated interior fireplace wall positioned behind the screen;

a first simulated fuel bed positioned in front of the screen;

the front surface of the screen comprising at least one observation region through which said part of said at least one simulated interior fireplace wall is observable, and a viewing region through which said at least one image of flames is transmittable;

a second simulated fuel bed positioned behind the screen and at least partially viewable through the screen;

the viewing region being at least partially reflective, for providing a virtual image of at least a reflected part of the first simulated fuel bed; and at least a preselected portion of the second simulated fuel bed being positioned relative to the virtual image such that the second simulated fuel bed appears to be part of the first simulated fuel bed.

2. A flame simulating assembly according to claim 1 in which the front surface of the screen comprises:

a transition region disposed between the viewing region and said at least one observation region;

said at least one image of flames being at least partly transmittable through the transition region; and said at least one simulated interior fireplace wall and said second simulated fuel bed being at least partially observable through the transition region.

3. A flame simulating assembly according to claim 1 in which said at least one simulated interior fireplace wall is a back wall and the flame simulating assembly additionally comprises side walls extending from the back wall beyond the front surface of the screen.

4. A flame simulating assembly according to claim 3 in which each of the back wall and the side walls has a pattern thereon resembling firebrick.

5. A flame simulating assembly according to claim 3 in which the back wall comprises firebricks and the side walls comprise patterns thereon resembling firebrick and aligned with the firebrick in the back wall.

6. A flame simulating assembly according to claim 3 additionally comprising a light control member positioned in said path of light from said at least one light source for obstructing light from said light source so that said light illuminates preselected portions of the back wall and the side walls.

7. A flame simulating assembly according to claim 1 additionally comprising at least one background light source for providing light to at least partially illuminate said at least one simulated interior fireplace wall.

8. A flame simulating assembly for providing at least one image of flames, the flame simulating assembly comprising:

a first simulated fuel bed;

at least one light source for producing said at least one image of flames;

a screen positioned behind the first simulated fuel bed, the screen comprising a front surface adjacent to the first simulated fuel bed;

the screen being positioned in a path of light from said at least one light source and adapted for transmission of said at least one image of flames through the screen;

at least one simulated interior fireplace wall positioned behind the screen;

the front surface of the screen comprising:

a partially reflective viewing region disposed proximate to the first simulated fuel bed, said at least one image of flames being transmittable through the viewing region;

an observation region disposed distal to the first simulated fuel bed, the observation region being adapted to permit observation of at least part of said at least one simulated interior fireplace wall through the observation region;

the viewing region providing a virtual image of at least a reflected part of the first simulated fuel bed; and a second simulated fuel bed positioned behind the screen and at least partially observable through the screen, said second simulated fuel bed comprising a preselected portion thereof positioned relative to the virtual image such that the second simulated fuel bed appears to be part of the first simulated fuel bed.

9. A flame simulating assembly according to claim 8 additionally comprising a transition region disposed between the observation region and the viewing region, said at least one simulated interior fireplace wall being at least partially observable through the transition region, and said at least one image of flames being at least partially transmittable through the transition region.

10. A flame simulating assembly according to claim 8 in which the screen additionally comprises a diffusing portion of a back surface located behind the viewing region on the front surface, the diffusing portion being adapted to diffuse light transmitted therethrough.

11. A flame simulating assembly according to claim 8 in which said at least one simulated interior fireplace wall comprises a pattern simulating firebrick thereon.

12. A flame simulating assembly according to claim 11 additionally including a housing, said at least one simulated interior fireplace wall being mounted on a back wall of the housing.

13. A flame simulating assembly according to claim 12 in which the housing comprises at least two simulated interior fireplace side walls, and each of said at least two simulated interior fireplace side walls extends forwardly from said back wall.

14. A flame simulating assembly according to claim 13 in which said at least two simulated interior fireplace side walls extend forwardly from said back wall beyond the front surface of the screen.

15. A flame simulating assembly according to claim 14 in which said at least two simulated interior fireplace side walls comprise patterns simulating firebrick thereon, said patterns being configured to mate with the firebrick pattern on said at least one simulated interior fireplace wall.

16. A flame simulating assembly according to claim 8 comprising a flame effect element for configuring light from said at least one light source to form said at least one image of flames, the flame effect element being positioned in the path of light between said at least one light source and the screen.

17. A flame simulating assembly according to claim 8 comprising a flicker element for causing light from said at least one light source to fluctuate to form said at least one image of flames, the flicker element being positioned in the path of light between said at least one light source and the screen.

18. A flame simulating assembly for providing at least one image of flames, the flame simulating assembly comprising:

a first simulated fuel bed;

a screen positioned behind the first simulated fuel bed, the screen comprising a front surface adjacent to the first simulated fuel bed and being adapted for transmission of said at least one image of flames therethrough;

at least one simulated interior fireplace wall positioned behind the screen;

at least one light source for producing said at least one image of flames;

a flicker element positioned in a path of light between said at least one light source and the screen for causing light from said at least one light source to fluctuate;

the screen being positioned in a path of fluctuating light from said at least one light source, such that said at least one image of flames is transmittable therethrough;

the front surface comprising:

a viewing region disposed proximate to the first simulated fuel bed, said at least one image of flames being transmittable through the viewing region;

an observation region disposed distal to the first simulated fuel bed, the observation region being adapted to permit observation of at least part of said at least one simulated interior fireplace wall through the observation region;

a second simulated fuel bed positioned behind the screen and at least partially viewable through the screen;

the viewing region of the front surface of the screen at least partially reflecting an image of the first simulated fuel bed; and at least a preselected portion of the second simulated fuel bed being substantially aligned with said image of the first simulated fuel bed such that the second simulated fuel bed appears to be part of the first simulated fuel bed.

* * * * *